US009309075B2

(12) United States Patent
Ochi et al.

(10) Patent No.: US 9,309,075 B2
(45) Date of Patent: Apr. 12, 2016

(54) SHEET PROCESSING APPARATUS AND IMAGE FORMING APPARATUS

(71) Applicant: CANON KABUSHIKI KAISHA, Tokyo (JP)

(72) Inventors: Junichi Ochi, Mishima (JP); Hiroharu Tsuji, Numazu (JP); Tomooku Koyama, Suntou-gun (JP); Takuya Keino, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/349,380

(22) PCT Filed: Oct. 5, 2012

(86) PCT No.: PCT/JP2012/006449

§ 371 (c)(1),
(2) Date: Apr. 3, 2014

(87) PCT Pub. No.: WO2013/051291

PCT Pub. Date: Apr. 11, 2013

(65) Prior Publication Data

US 2014/0284875 A1 Sep. 25, 2014

(30) Foreign Application Priority Data

Oct. 6, 2011 (JP) ..... 2011-221742

(51) Int. Cl.

| | |
|---|---|
| ***B65H 7/20*** | (2006.01) |
| ***B65H 29/12*** | (2006.01) |
| ***B65H 29/66*** | (2006.01) |

(Continued)

(52) U.S. Cl.

CPC ..... *B65H 7/20* (2013.01); *B65H 5/062* (2013.01); *B65H 7/18* (2013.01); *B65H 9/002* (2013.01); *B65H 29/125* (2013.01); *B65H 29/6609* (2013.01); *B65H 31/36* (2013.01); *B65H 2301/4213* (2013.01); *B65H 2404/14* (2013.01); *B65H 2404/147* (2013.01)

(58) Field of Classification Search

CPC ..... B65H 9/002; B65H 9/004; B65H 11/007; B65H 29/6636; B65H 29/6645; B65H 31/02; B65H 31/36; B65H 2301/444

USPC ..... 271/237, 245, 246

See application file for complete search history.

(56) References Cited

U.S. PATENT DOCUMENTS

| | | | |
|---|---|---|---|
| 5,090,674 | A | 2/1992 | Ozawa |
| 7,040,616 | B2 | 5/2006 | Stemmle |

(Continued)

FOREIGN PATENT DOCUMENTS

| | | | |
|---|---|---|---|
| DE | 10335418 | B3 | 12/2004 |
| EP | 342704 | A2 | 11/1989 |

(Continued)

*Primary Examiner* — Jeremy R Severson

(74) *Attorney, Agent, or Firm* — Fitzpatrick, Cella, Harper & Scinto

(57) ABSTRACT

A conveying portion includes a pair of superimposing rollers and a controller which controls the rotation of the pair of superimposing rollers, wherein the controller controls a rotation of a pair of conveying rollers so that a tail end of a first sheet passes a nip portion between the pair of conveying rollers by conveying the first sheet to the downstream side before a leading end of a third sheet superimposed on a second sheet reaches the nip portion between the pair of conveying rollers nipping the first sheet and the second sheet superimposed on the first sheet.

20 Claims, 15 Drawing Sheets

(51) Int. Cl.

| | |
|---|---|
| ***B65H 31/36*** | (2006.01) |
| ***B65H 5/06*** | (2006.01) |
| ***B65H 7/18*** | (2006.01) |
| ***B65H 9/00*** | (2006.01) |

(56) References Cited

U.S. PATENT DOCUMENTS

| | | | | |
|---|---|---|---|---|
| 7,581,726 | B2 | 9/2009 | Seiler | |
| 7,697,883 | B2 | 4/2010 | Ogata et al. | |
| 7,850,161 | B2 | 12/2010 | Fukatsu et al. | |
| 7,963,523 | B2 | 6/2011 | Yoshimura et al. | |
| 8,360,421 | B2 | 1/2013 | Tsuji et al. | |
| 2008/0073837 | A1* | 3/2008 | DeGruchy | 271/273 |
| 2010/0283200 | A1* | 11/2010 | Bober et al. | 271/277 |
| 2014/0239580 | A1* | 8/2014 | Yoshida et al. | 271/245 |

FOREIGN PATENT DOCUMENTS

| | | | |
|---|---|---|---|
| EP | 1431049 | A1 | 6/2004 |
| EP | 2128061 | A1 | 12/2009 |
| JP | 10-194569 | A | 7/1998 |

* cited by examiner

SHEET PROCESSING APPARATUS AND IMAGE FORMING APPARATUS

BACKGROUND OF THE INVENTION

1. Field of the Invention

The present invention relates to a sheet processing apparatus which processes a sheet and to an image forming apparatus.

2. Description of the Related Art

Hitherto, a sheet processing apparatus such as a sorter which sorts a sheet having an image formed thereon is connected to an image forming apparatus such as an electrophotographic copying machine or a laser beam printer. This kind of sheet processing apparatus is equipped with not only a sorting function, but also a function of aligning a plurality of sheets or producing a sheet bundle by a stapler that staples a plurality of sheets. For example, in the sheet processing apparatus equipped with the aligning function and the stapling function, the sheets conveyed from the image forming apparatus are aligned one by one by an aligning portion and the plurality of aligned sheets is bound by the stapler.

In recent years, Japanese Patent Laid-Open No. 10-194569 discloses a technique of saving a process time of a preceding sheet bundle stacked on a process tray, where first several sheets among sheets constituting a subsequent sheet bundle become a standby state and several sheets being in a standby state after processing the preceding sheet bundle are conveyed to the process tray in a superimposed state.

Japanese Patent Laid-Open No. 10-194569 discloses a configuration in which a large conveying roller causing conveyed sheets to be in a standby state is disposed inside a sheet processing apparatus. First, the large conveying roller rotates at a timing at which the first conveyed sheet is detected by a sheet detecting sensor, and the first sheet is wound on the large conveying roller. Next, the large conveying roller rotates at a timing at which a second sheet is detected by the sheet detecting sensor, and the second sheet is wound on the large conveying roller. Further, the large conveying roller rotates at a timing at which a third sheet is detected by the sheet detecting sensor, and the third sheet is wound on the large conveying roller. In this case, the second sheet is wound on the surface of the large conveying roller so as to advance in the rotation direction compared to the first sheet, and the third sheet is wound thereon so as to advance in the rotation direction compared to the second sheet. Then, after three sheets are wound on the large conveying roller, three sheets are peeled from the large conveying roller by a flapper and are conveyed to the process tray in a superimposed state. According to such a configuration, the second sheet is shifted by a predetermined amount to the downstream side with respect to the first sheet in the conveying direction, and the third sheet is shifted by a predetermined amount to the downstream side with respect to the second sheet in the conveying direction. Then, three sheets are conveyed in a superimposed state.

Further, conventionally, a method of causing sheet ends to bump into a sheet bumping surface is generally used in order to align the superimposed sheets in the conveying direction. At this time, the sheet end of the lower sheet of the superimposed sheets first bumps into the sheet bumping surface. This is because a unit for allowing the sheet end to bump into the sheet bumping surface is installed so as to act on the front surface of the upper sheet of the superimposed sheets. When the bumping unit acts on the front surface of the upper sheet of the superimposed sheets, the lower sheet is conveyed along with the upper sheet of the superimposed sheets by the friction generated between the sheets of the superimposed sheets, and the sheet end of the lower sheet first bumps into the sheet bumping surface. Subsequently, the upper sheet is conveyed onto the lower sheet by the bumping unit and the sheet end reliably bumps into the sheet bumping surface. Accordingly, the superimposed sheets are completely aligned in the conveying direction.

However, in the configuration of Japanese Patent Laid-Open No. 10-194569, there is a possibility that three sheets may be nipped between a pair of rollers so that three sheets may not be conveyed while being shifted by a predetermined amount. In a state where a pair of rollers nips three sheets, the second sheet is nipped between the first sheet and the third sheet, so that the second sheet may not directly come into contact with the pair of rollers. As a result, the second sheet may not be directly conveyed by the pair of rollers, and the second sheet is conveyed by the friction between the sheets. That is, three sheets may not be accurately conveyed, so that the sheets may not be conveyed while being shifted by a predetermined amount.

When three sheets may not be conveyed while being shifted by a predetermined amount, there is a possibility that the shift direction may be reversed until the superimposed sheet bundle is conveyed toward the sheet bumping surface. As illustrated in FIG. 5, the first sheet S1 is stacked on the stacking surface of the process tray, the second sheet S2 is stacked thereon, and the third sheet S3 is stacked thereon. Here, the friction coefficient between the aligning roller 18 and the third sheet S3 is denoted by m1, the friction coefficient between the third sheet S3 and the second sheet S2 is denoted by m2, and the friction coefficient between the second sheet S2 and the first sheet S1 is denoted by m3.

As illustrated in FIG. 5, when the aligning roller 18 comes into contact with the front surface of the third sheet S3, m1 is much larger than m2 or m3. Accordingly, the third sheet S3 advances farther than the second sheet S2, so that the second sheet S2 may not be aligned. That is, in a case where the aligning roller 18 comes into contact with the third sheet before the second sheet bumps into the aligning wall 19, slip occurs between the second sheet and the third sheet, and hence there is a possibility that the positional relation (hereinafter, the shift direction) between the downstream ends of the respective sheets may be reversed.

When the shift direction is reversed, the third sheet is conveyed by the aligning roller 18 until the third sheet S3 advances farther than the second sheet S2 and reaches the aligning wall 19 at the timing at which the second sheet S2 is supposed to advance farther than the third sheet S3. At the time point at which the third sheet S3 reaches the aligning wall 19, no conveying force generated by the friction between the sheets of the third sheet S3 is transmitted to the second sheet S2, and the second sheet S2 stops before reaching the aligning wall 19, so that the second sheet S2 may not come into contact with the aligning wall 19.

Due to these reasons, in order to prevent a change in the shift direction of the superimposed sheets, the configuration disclosed in Japanese Patent Laid-Open No. 10-194569 may suppose a countermeasure in which the shift amount is set sufficientlyin advance so as to maintain the shift direction even when a slight externalinfluence occurs during the conveying operation. For this reason, the diameter of thelarge conveying roller needs to be large so as to ensure a circumferential length including the shift amount set to be sufficient for the sheet length of the maximum wound sheet. Thus, there is a problem in which the apparatus increases in size or the number of sheets per unit time is small, that is, the productivity is degraded when outputting the shorter sheet.

Therefore, it is an object of the invention to provide a sheet processing apparatus capable of highly precisely managing a shift amount or a shift direction of a plurality of sheets which is conveyed while being superimposed on each other in a step shape.

SUMMARY OF THE INVENTION

A sheet processing apparatus includes: a conveying unit which conveys sheets in order from a first sheet, a second sheet, and a third sheet; a pair of first conveying rollers which is installed at the downstream of the conveying unit and conveys the sheets while nipping the sheets at a nip portion; a superimposing unit which is installed between the conveying unit and the pair of first conveying rollers and superimposes a subsequent sheet on a preceding sheet in the conveying direction, the superimposing unit being configured to superimpose the second sheet on the first sheet and superimpose the third sheet on the second sheet; and a control unit which controls the rotation of the pair of first conveying rollers, wherein the control unit controls the rotation of the pair of first conveying rollers so that a tail end of the first sheet passes the nip portion of the pair of first conveying rollers by conveying the first sheet before a leading end of the third sheet superimposed on the second sheet reaches the nip portion between the pair of first conveying rollers nipping the first sheet and the second sheet superimposed on the first sheet.

A sheet processing apparatus includes: a conveying unit which conveys sheets in order from a first sheet, a second sheet, and a third sheet; a pair of first conveying rollers which is installed at a downstream side of the conveying unit and conveys the sheets while nipping the sheets at a nip portion; a superimposing unit which is installed between the conveying unit and the pair of first conveying rollers and superimposes a subsequent sheet on a preceding sheet in the conveying direction, the superimposing unit being configured to superimpose the second sheet on the first sheet and superimpose the third sheet on the second sheet; a pair of second conveying rollers which is installed at a downstream side of the pair of first conveying rollers and conveys the sheets while nipping the sheets at the nip portion; and a control unit which controls a rotation of the pair of first conveying rollers and a rotation of the pair of second conveying rollers, wherein the control unit controls the rotation of the pair of first conveying rollers and the pair of second conveying rollers so that a leading end of the second sheet reaches the nip portion between the pair of second conveying rollers nipping the first sheet by conveying the second sheet to a downstream side before a leading end of the third sheet superimposed on the second sheet reaches the nip portion between the pair of first conveying rollers nipping the first sheet and the second sheet superimposed on the first sheet.

According to the configuration of the invention, the shift amount or the shift direction of the plurality of sheets conveyed while being superimposed on each other in a step shape is highly precisely managed.

Further features of the present invention will become apparent from the following description of exemplary embodiments with reference to the attached drawings.

DESCRIPTION OF THE EMBODIMENTS

Figure 1:
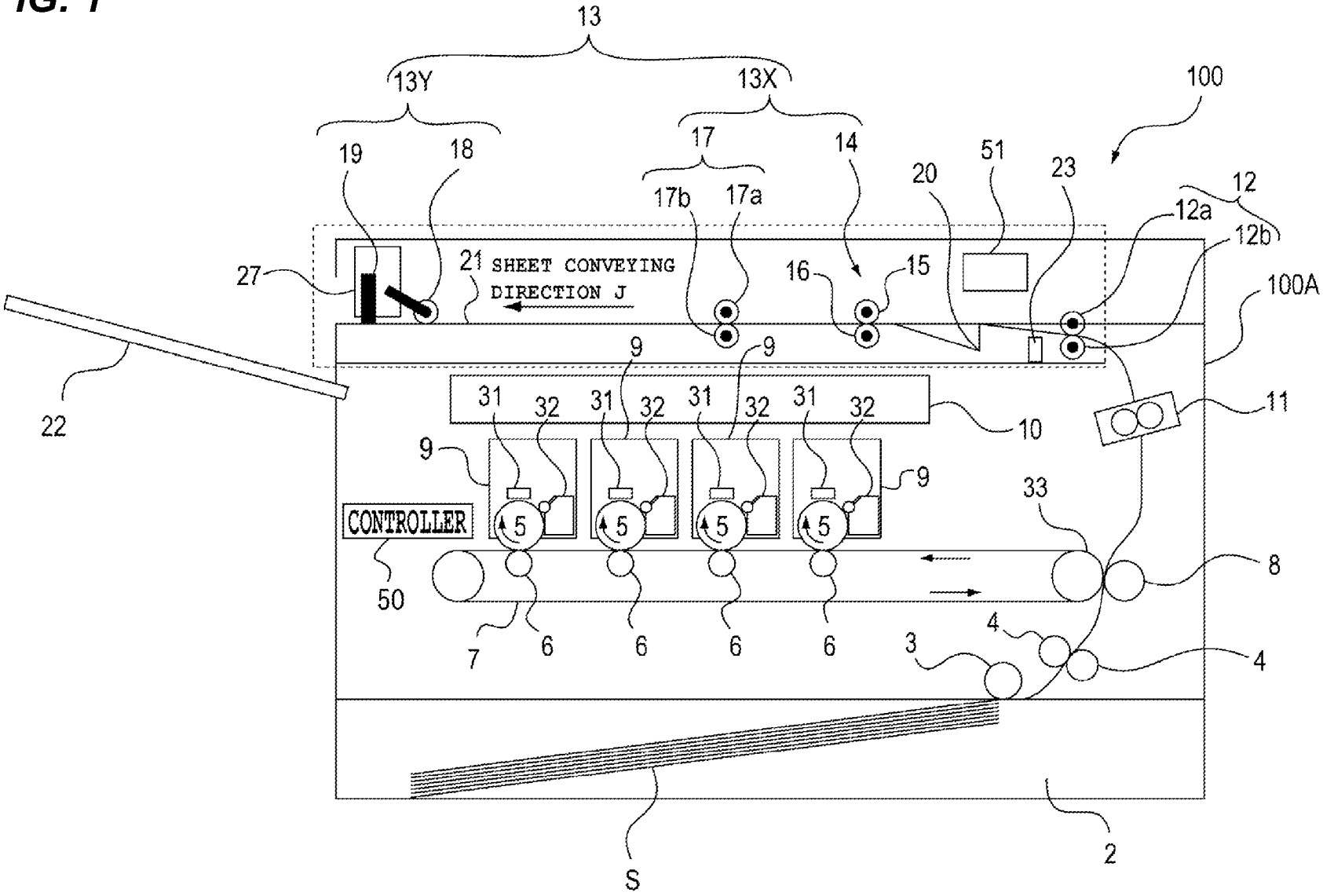
FIG. 1 is a cross-sectional view illustrating a configuration of an image forming apparatus according to a first embodiment of the invention.

Hereinafter, referring to the drawings, a mode for carrying out the invention will be exemplarily described in detail based on embodiments. Here, since the dimension, the material, the shape, the relative position, and the like of the components described in the embodiments are appropriately changed by the configuration or various conditions of the apparatus to which the invention is applied, the scope of the invention is not limited thereto unless a particular description is made.

First Embodiment

Figure 15:
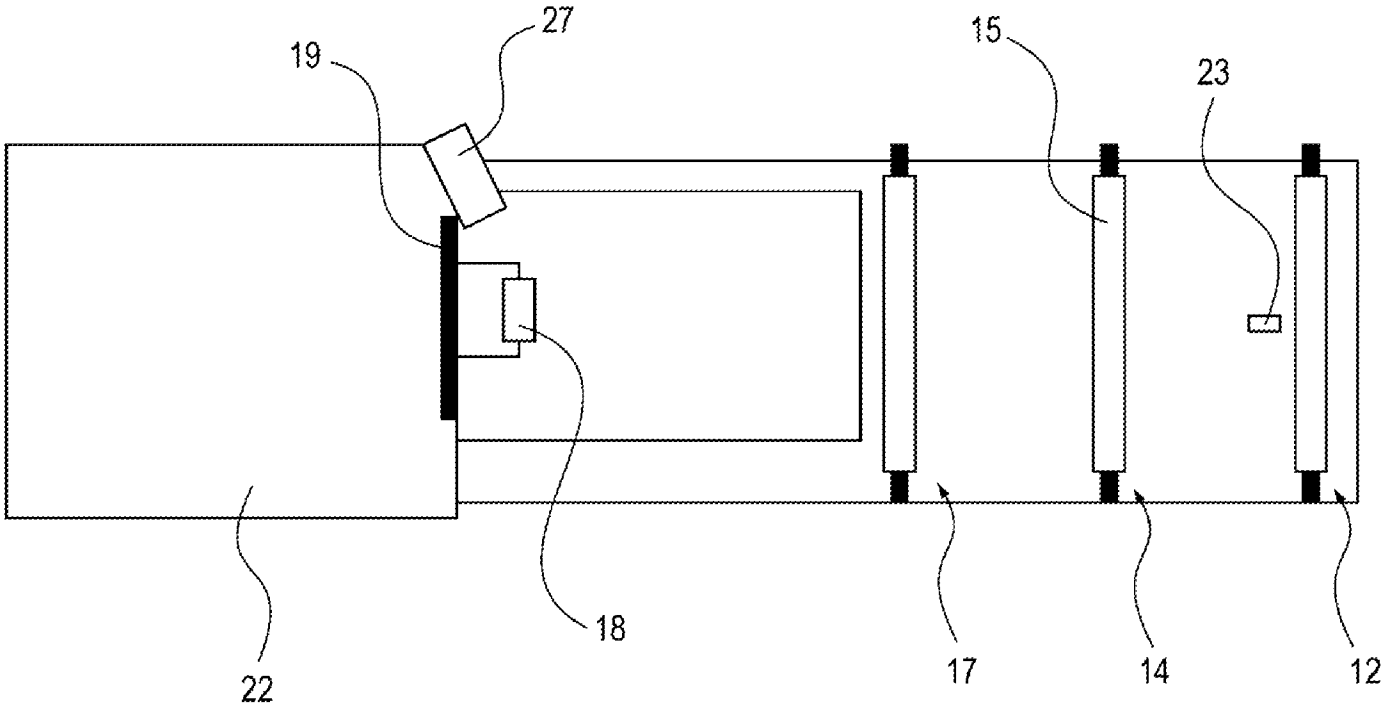
FIG. 15 is a cross-sectional view when the sheet processing system is seen from the upside.

FIG. 1 is a cross-sectional view illustrating a configuration of an image forming apparatus 100 according to a first embodiment of the invention. FIG. 15 is a cross-sectional view of the image forming apparatus 100 of FIG. 1 when seen from the upside. The image forming apparatus 100 as the "image forming system" is a full-color laser beam printer which uses an electrophotographic image forming process. As illustrated in FIG. 1, the image forming apparatus 100 includes an image forming apparatus body (hereinafter, simply referred to as an "apparatus body") 100A, and an image forming portion which forms an image is installed inside the apparatus body 100A. The image forming portion includes a photosensitive drum 5 as an "image bearing member", a primary transfer roller 6 as a "transfer device", and the like. At least the photosensitive drum 5 is included in a process cartridge 9, and is assembled as the process cartridge 9 to the apparatus body 100A.

The image forming apparatus 100 includes an accommodating cassette 2, a feeding roller 3, a registration roller 4, the primary transfer roller 6, an intermediate transfer belt 7, a secondary transfer roller 8, the process cartridge 9, an optical unit 10, a fixing unit 11, a pair of discharge rollers 12, and a sheet processing apparatus 13. The process cartridge 9 includes the photosensitive drum 5, a primary charger 31, and a developing device 32.

In the image forming portion, first, the primary charger 31 evenly charges the surface of the photosensitive drum 5. Next, the optical unit 10 forms an electrostatic image by irradiating a laser beam to the surface of the photosensitive drum 5. Next, the developing device 32 develops the electrostatic image by toner. The image forming process is performed by the process cartridge 9 of respective colors of yellow, magenta, cyan, and black. The toner image on the surface of the photosensitive drum 5 is sequentially transferred in a superimposed manner onto the surface of the intermediate transfer belt 7 which rotates and travels. Then, the entire toner image of the surface of the intermediate transfer belt 7 is secondarily transferred onto the conveyed sheet S at the nip portion between the secondary transfer roller 8 and a secondary transfer counter roller 33.

On the other hand, the sheets S are stacked inside the accommodating cassette 2, are fed to the feeding roller 3, and are conveyed to the registration roller 4. Then, the toner image is transferred onto the sheet S at the nip portion between the secondary transfer roller 8 and the secondary transfer counter roller 33. After the toner image is transferred, the sheet S is conveyed to the fixing unit 11. The toner is melted by heat and a pressure, and is fixed onto the sheet S. Subsequently, the sheet S passes the pair of discharge rollers 12, and is conveyed to the sheet processing apparatus 13 as the sheet conveying apparatus.

The sheet processing apparatus 13 is connected to the apparatus body 100A, and is controlled so that the sheet processing apparatus functions as the image forming system. A controller 50 which controls the driving of various built-in units is disposed inside the apparatus body 100A. Further, a controller 51 is also separately installed in the sheet processing apparatus 13, and controls the sheet processing apparatus 13 by the communication with the controller 50 in the apparatus body 100A (see FIG. 3A).

Furthermore, the controller 50 may be configured to directly control the sheet processing apparatus 13. The sheet processing apparatus 13 may be integrally mounted on the apparatus body 100A or may be provided as an external option. Hereinafter, in the description of the sheet processing apparatus 13, the downstream end of the conveyed sheet S in the sheet conveying direction J will be referred to as a "downstream end" or a "leading end", and the upstream end of the conveyed sheet S in the sheet conveying direction J will be referred to as an "upstream end" or a "tail end". Further, with regard to the relation between a first sheet S1 and a second sheet S2 which are sequentially conveyed, the first sheet S1 corresponds to a "preceding sheet" and the second sheet S2 corresponds to a "subsequent sheet". Further, with regard to the relation between the second sheet S2 and a third sheet S3 which are sequentially conveyed, the second sheet S2 corresponds to a "preceding sheet" and the third sheet S3 corresponds to a "subsequent sheet".

The sheet processing apparatus 13 includes a conveying portion 13X which serves as a "sheet conveying portion", and a processing portion 13Y which is disposed at the downstream of the conveying portion 13X in the sheet conveying direction J and serves as a "sheet processing portion" for processing a sheet. The conveying portion 13X includes a pair of superimposing rollers 14 and a pair of bundle conveying rollers 17. The processing portion 13Y includes an aligning roller 18 and an aligning wall 19 which align the sheets S. Furthermore, the controller 51 is characterized in that the conveying portion 13X buffers the subsequent sheet while the processing portion 13Y handles the preceding job. Further, the sheet processing apparatus 13 includes a pair of discharge rollers 12 as a sheet conveying unit which conveys the sheets having an image formed thereon by the image forming portion in order of the first sheet, the second sheet, and the third sheet. Further, the sheet processing apparatus 13 includes a sensor 23 as a detecting unit which is disposed at the downstream of the pair of discharge rollers 12 in the sheet conveying direction J so as to detect the sheet which is conveyed to the upstream of the pair of superimposing rollers 14 in the sheet conveying direction J. Further, the sheet processing apparatus 13 includes a step 20 which causes the sheets to be superimposed on each other at the downstream of the sensor 23 and the upstream of the pair of superimposing rollers 14. In the embodiment, the subsequent sheet which is conveyed by the step 20 and the pair of discharge rollers 12 may be superimposed on the preceding sheet on the step 20.

The pair of superimposing rollers 14 as the "pair of first conveying rollers" is a pair of rollers which is disposed at the downstream of the pair of discharge rollers 12 in the sheet conveying direction and causes the plurality of sheets to be superimposed on each other. The pair of superimposing rollers 14 has a function of temporarily holding (buffering) the plurality of sheets by an operation described later. Furthermore, the buffering is performed so as to cause the subsequent sheet, which is immediately and continuously output during the process operation of the preceding job, to be in a standby state.

The pair of superimposing rollers 14 includes a lower roller 16 as a "first roller" disposed at the lower side and an upper roller 15 as a "second roller" disposed at the upper side. The upper roller 15 and the lower roller 16 are so-called passage rollers which face each other and have a roller portion throughout the entire region of the sheet width direction M (the direction perpendicular to the paper surface of FIG. 1) perpendicular to the sheet conveying direction J. Incidentally, the upper roller 15 and the lower roller 16 may be configured as dividing rollers which are divided into a plurality of segments in the sheet width direction. Furthermore, it is desirable that the material of the roller is a solid or foamed rubber roller having a high friction coefficient.

The lower roller 16 forms the upper roller 15 and a nip by pressurizing bearing portions (not illustrated) of both end portions through springs (not illustrated). The driving and the stopping of the upper roller 15 and the lower roller 16 can be both controlled. The respective rollers may be connected to a motor (see FIG. 3A), may branch a driving force from a single motor, and may include a device such as an electromagnetic clutch which is provided halfway so as to control the transmission of the driving force. Furthermore, a torque limiter (not illustrated) as a brake unit which decelerates or stops the rotation of the lower roller 16 is provided on the shaft of the lower roller 16.

The pair of bundle conveying rollers 17 as the "pair of second conveying rollers" is disposed on the downstream of the pair of superimposing rollers 14 in the sheet conveying direction J. The pair of bundle conveying rollers 17 conveys the sheet bundle which is conveyed from the pair of superimposing rollers 14. The pair of bundle conveying rollers 17 is able to come into contact with each other or separate from each other, and separates from each other so as to release the nip when aligning the sheets.

The aligning roller 18 is disposed at the downstream of the pair of bundle conveying rollers 17 in the sheet conveying direction J, comes into contact with the surface of the conveying surface 21, and moves the sheet S to the aligning wall 19 so that the sheet bumps thereinto. The aligning wall 19 is a wall which is disposed at the downstream of the aligning roller 18 in the sheet conveying direction J and aligns the conveyed sheet bundle in the conveying direction. When the controller 51 controls the driving of the pair of superimposing rollers 14, the sheets from the first sheet to the n-th sheet (n is a natural number equal to or larger than 2) enters the aligning roller 18 in order from the preceding conveyed sheet, bumps into the aligning wall 19, and is aligned in the sheet conveying direction J. A stapler 27 (a stapling device) is provided between the aligning roller 18 and the aligning wall 19 in the sheet conveying direction J.

The stapler 27 which is disposed in the aligning wall 19 staples the sheet bundle which is aligned by bumping into the aligning wall 19 by the aligning roller 18. Subsequently, the aligning wall 19 is retracted after the stapling is completed and the sheet bundle is discharged to the discharge tray 22 by a discharging unit (not illustrated). Next, referring to FIG. 2 and the subsequent drawings, the operation of the sheet processing apparatus 13 will be described.

Although it will be described later in detail, the controller 51 as the "control unit" controls the rotation of the pair of superimposing rollers 14 and the pair of bundle conveying rollers 17. Here, as described above, the controller 50 may control the rotation of the pair of superimposing rollers 14 and the pair of bundle conveying rollers 17 by using the controller 50 as the "control unit".

Figure 2:
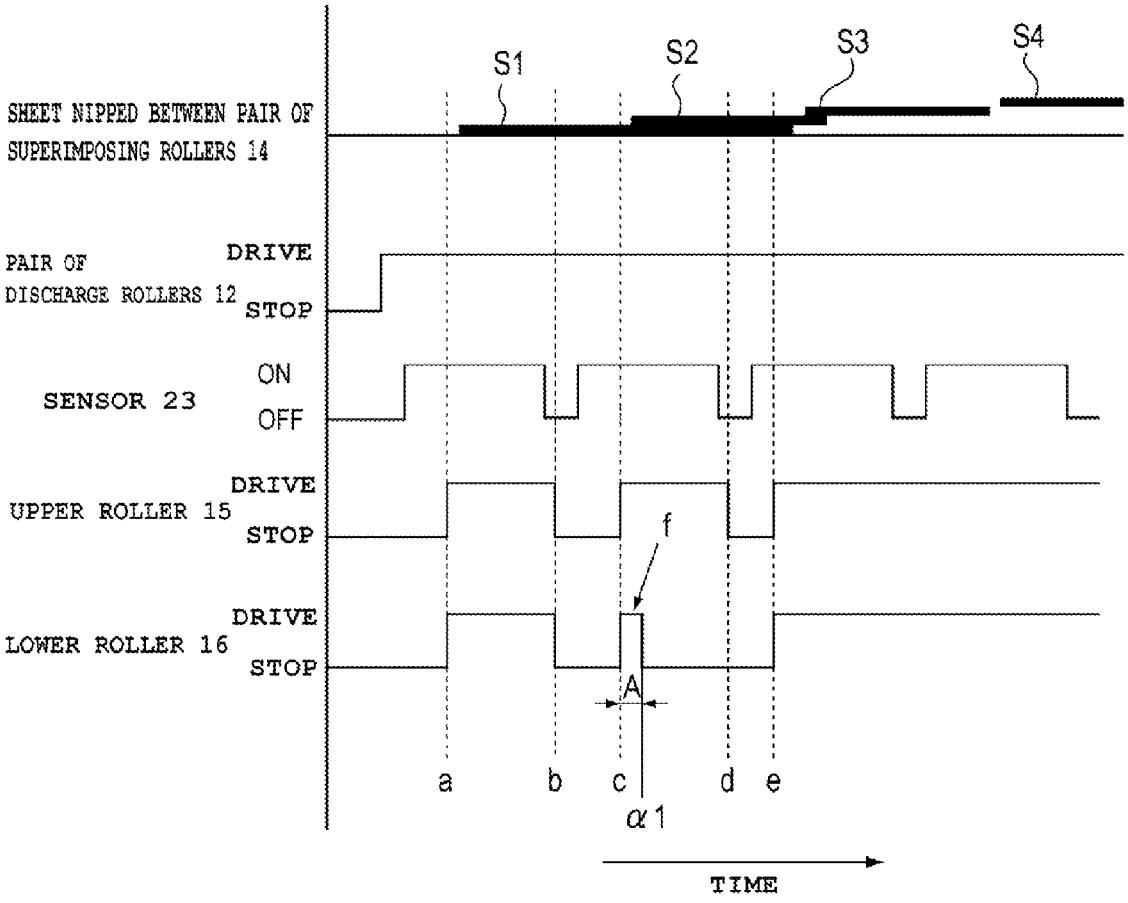
FIG. 2 is a timing chart illustrating a conveying timing at which a sheet nipped between a pair of superimposing rollers is conveyed and a driving timing at which a pair of discharge rollers, a sensor, an upper roller, and a lower roller are driven.

FIG. 2 is a timing chart illustrating a conveying timing at which the sheet nipped between the pair of superimposing rollers 14 is conveyed and a driving timing at which the pair of discharge rollers 12, the sensor 23, the upper roller 15, and the lower roller 16 are driven. In the description of the timing, the timing will be described in order from the timing a to the timing e. First, the controller 51 drives the pair of discharge rollers 12 so as to discharge the sheet S1 having an image formed thereon. When the leading end of the sheet S1 conveyed by the pair of discharge rollers 12 passes the sensor 23, the sensor 23 is turned on.

The controller 51 drives the upper roller 15 and the lower roller 16 so as to match the timing at which the leading end of the sheet S1 reaches the pair of superimposing rollers 14 in response to the detection signal from the sensor 23 that detects the leading end of the sheet S1 (see the timing a). At this time, the upper roller 15 and the lower roller 16 are rotationally driven at the same circumferential velocity. Incidentally, the controller 51 may rotate the upper roller 15 in a driven manner just by rotationally driving the lower roller 16.

When the tail end of the sheet S1 which is conveyed by rotationally driving the upper roller 15 and the lower roller 16 passes the sensor 23, the sensor 23 is turned off. The controller 51 stops the driving of the upper roller 15 and the lower roller 16 in response to the detection signal from the sensor 23 that detects the tail end of the sheet S1 (see the timing b). Accordingly, the sheet S1 is conveyed by a predetermined distance by the pair of superimposing rollers 14, and then is maintained to be nipped between the pair of superimposing rollers 14. Furthermore, since the sheet S2 is superimposed on the sheet S1, the stop position of the sheet S1 is set as a position at which the tail end of the sheet S1 slightly passes by the step 20 (see FIG. 1).

Subsequently, the sheet S2 having an image formed thereon is conveyed toward the processing apparatus 13 by the pair of discharge rollers 12. The sheet S2 which is conveyed by the pair of discharge rollers 12 may be superimposed on the sheet S1 in the sheet conveying direction J by passing the step 20. Further, when the leading end of the sheet S2 passes the sensor 23, the sensor 23 is turned on. The controller 51 drives the upper roller 15 and the lower roller 16 so as to match the timing at which the leading end of the sheet S2 reaches the pair of superimposing rollers 14 in response to the detection signal from the sensor 23 that detects the leading end of the sheet S2 (see the timing c). Accordingly, the sheet S2 is conveyed into the nip portion between the pair of superimposing rollers 14 along the front surface of the sheet S1.

Subsequently, the controller 51 immediately stops the driving of the lower roller 16. Specifically, the controller 51 drives the lower roller 16 only for the time f, and stops the driving of the lower roller 16 (see the timing a1). In this way, since the controller 51 rotates both the upper roller 15 and the lower roller 16 when the sheet S2 is conveyed into the nip portion between the pair of superimposing rollers 14, the posture of the sheet S1 is not disturbed by the influence generated when the sheet S2 is conveyed thereinto.

Subsequently, since the controller 51 drives only the upper roller 15, the sheet S2 is conveyed to the downstream while being superimposed on the stopped sheet S1. Then, when the tail end of the sheet S2 passes the sensor 23, the sensor 23 is turned off. In this way, since the controller 51 drives only upper roller 15, the superimposed amount of the sheet S2 superimposed on the sheet S1 in the conveying direction is controlled.

Figure 3A:
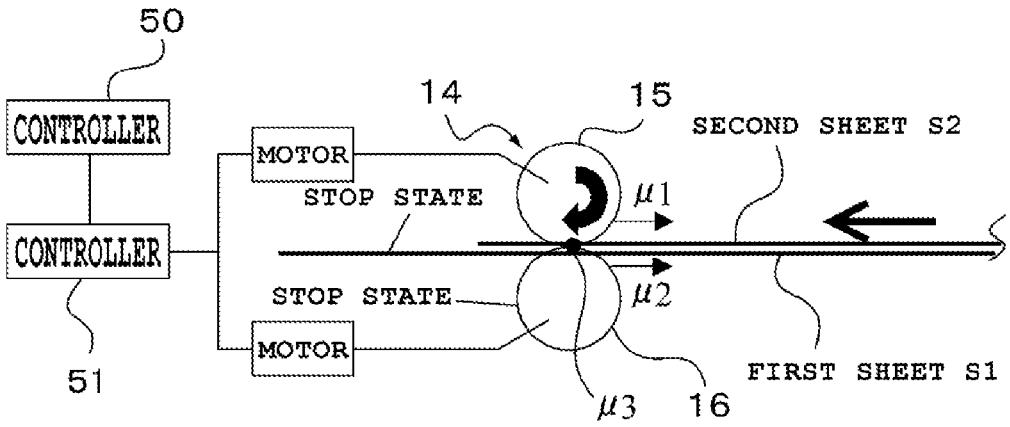
FIG. 3A is a cross-sectional view illustrating a state where a second sheet is conveyed into the pair of superimposing rollers while being superimposed on a first sheet.

FIG. 3A is a cross-sectional view illustrating a state where the sheet S2 is conveyed into the pair of superimposing rollers 14 while being superimposed on the sheet S1. As described above, the controller 51 stops the lower roller 16 while the sheet S2 is conveyed to the downstream by the upper roller 15. Accordingly, as illustrated in FIG. 3A, since only the upper roller 15 rotates, the sheet S2 may be superimposed on the sheet S1 while sliding thereon.

During a time at which the controller 51 just rotates the upper roller 15 so as to convey the sheet S2, the lower roller 16 is stopped while being braked by a torque limiter (not illustrated).

Here, the friction between the upper roller 15 and the second sheet S2 is denoted by $\mu 1$, the friction between the lower roller 16 and the first sheet S1 is denoted by $\mu 2$, and the friction between the first sheet S1 and the second sheet S2 is denoted by $\mu 3$. Then, since the relation of $\mu 1>\mu 3$ and $\mu 2>\mu 3$ is established, the sheet S2 can be conveyed while rubbing the stopped sheet S1 just by rotating the upper roller 15.

The controller 51 performs control so that the timing of driving the upper roller 15 changes based on the information of the timing at which the sensor 23 detects the passage of the sheet S2. For this control, as for the stopped position of the sheet S2, the leading end of the sheet S2 is disposed on the upstream side by a predetermined shift amount L in the sheet conveying direction J in relation to the leading end of the sheet S1 (the timing $\alpha 1$ to the timing d).

Subsequently, the sheet S3 having an image formed thereon is conveyed toward the processing apparatus 13 by the pair of discharge rollers 12. The sheet S3 which is conveyed by the pair of discharge rollers 12 may be superimposed on the sheet S2 in the sheet conveying direction J by passing the step 20. Further, when the leading end of the sheet S3 passes the sensor 23, the sensor 23 is turned on. The controller 51 drives the upper roller 15 and the lower roller 16 so as to match the timing at which the leading end of the sheet S3 reaches the pair of superimposing rollers 14 in response to the detection signal from the sensor 23 that detects the leading end of the sheet S3 (see the timing e). Accordingly, the sheet S3 is conveyed into the nip portion between the pair of superimposing rollers 14 along the front surface of the sheet S2.

The controller 51 controls the driving of the pair of superimposing rollers 14 so that the tail end of the sheet S1 in the sheet conveying direction J passes before the leading end of the sheet S3 in the sheet conveying direction J reaches the nip portion between the pair of superimposing rollers 14. Specifically, the controller 51 rotates the upper roller 15 and the lower roller 16 at the same circumferential velocity (the timing e). Accordingly, the sheet S1 and the sheet S2 are conveyed in a superimposed bundle state by the upper roller 15 and the lower roller 16.

Figure 3B:
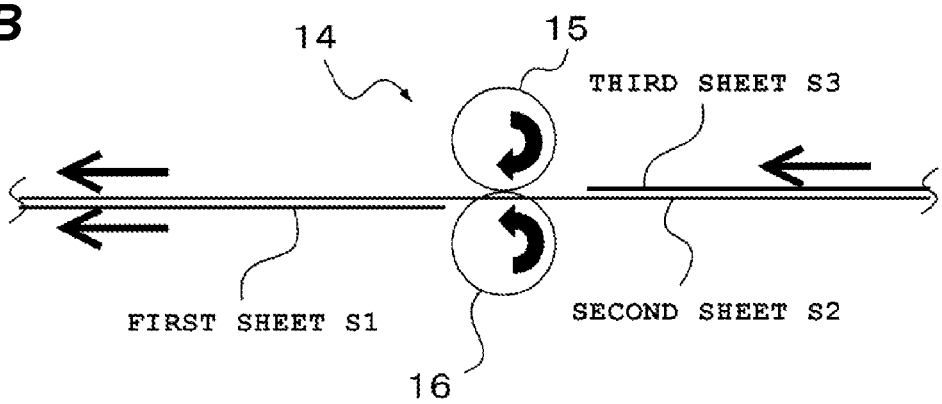
FIG. 3B is a cross-sectional view illustrating a state immediately before a third sheet is conveyed into the pair of superimposing rollers while being superimposed on the second sheet.

FIG. 3B is a cross-sectional view illustrating a state immediately before the third sheet S3 is conveyed into the pair of superimposing rollers 14 while being superimposed on the second sheet S2. As illustrated in FIG. 3B, the tail end of the sheet S1 passes the nip portion between the pair of superimposing rollers 14 before the leading end of the sheet S3 conveyed by the discharge roller 12 is conveyed into the nip portion between the pair of superimposing rollers 14. Subsequently, the pair of superimposing rollers 14 nips the sheets S3 superimposed on the sheet S2 while being shifted thereto in the sheet conveying direction J together with the sheet S2 (see FIG. 3C).

Figure 3C:
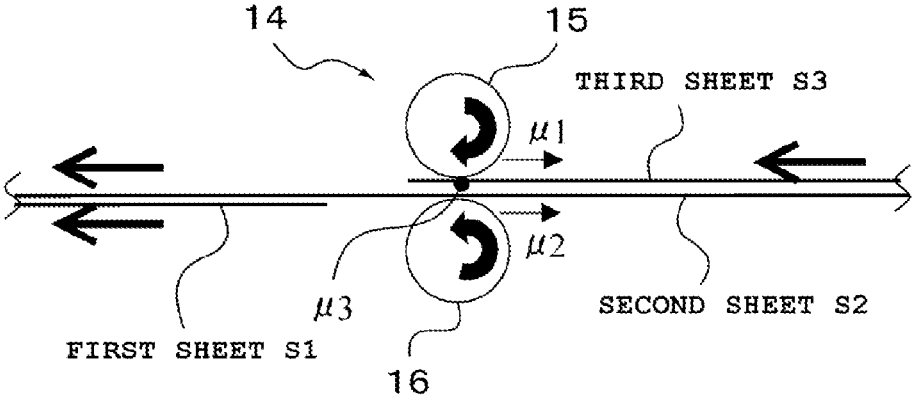
FIG. 3C is a cross-sectional view illustrating a state where the third sheet is conveyed into the pair of superimposing rollers while being superimposed on the second sheet.

FIG. 3C is a cross-sectional view illustrating a state where the sheet S3 is conveyed into the pair of superimposing rollers 14 while being superimposed on the sheet S2. Referring to FIG. 3C, the reason why the pair of superimposing rollers 14 stably conveys the sheet in a case where the number of sheets nipped between the pair of superimposing rollers 14 is two or less will be described. When the friction between the upper roller 15 and the sheet S3 is denoted by $\mu 1$, the friction between the lower roller 16 and the sheet S2 is denoted by $\mu 2$, and the friction between the sheet S2 and the sheet S3 is denoted by $\mu 3$, the relation of $\mu 1>\mu 3$ and $\mu 2>\mu 3$ is established. Accordingly, the sheet S2 and the sheet S3 do not move by the friction $\mu 3$ between the sheets, the sheet S2 is conveyed by the lower roller 16, and the sheet S3 is conveyed by the upper roller 15. That is, since the movement of the sheet S2 and the sheet S3 is dominated by the rollers which directly come into contact with the sheets, the stable conveying operation may be performed.

Figure 4A:
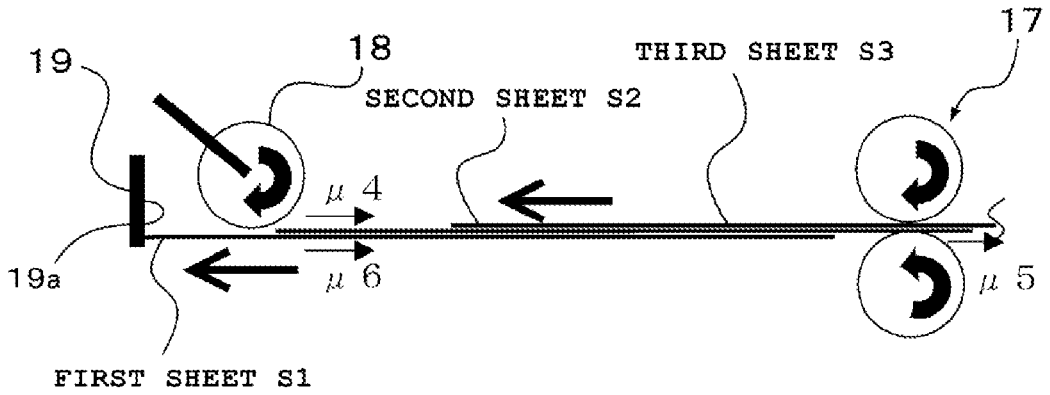
FIG. 4A is a cross-sectional view illustrating a state where the first sheet to the third sheet are superimposed on each other and are conveyed into an aligning wall.

Subsequently, an operation will be described in which the sheet S1, the sheet S2, and the sheet S3 superimposed on each other as three sheets are conveyed. As illustrated in FIG. 4A, the sheets S1, S2, and S3 which are conveyed by the pair of superimposing rollers 14 are conveyed to the aligning roller 18 by the pair of bundle conveying rollers 17. Furthermore, the controller 51 maintains the driving state of the upper roller 15 and the lower roller 16 until the leading end of the sheet S3 reaches the nip portion between the pair of superimposing rollers 14 and then reaches the nip portion between the pair of bundle conveying rollers 17 (see the timing after the timing e illustrated in FIG. 2).

The sheets which are conveyed by the pair of bundle conveying rollers 17 are conveyed to the aligning roller 18. The sheets may bump into the aligning wall 19 in order from the first sheet by rotationally driving the aligning roller 18. Here, the aligning roller 18 slightly sets the pressure applied to the sheet and the friction m4 against the sheet so that the sheet is not buckled when the sheet bumps into the aligning wall 19.

When the friction between the rear surface of the sheet S1 and the conveying surface 21 (see FIG. 1) at the contact portion between the aligning roller 18 and the sheet is denoted by $\mu 6$ and the friction between the pair of bundle conveying rollers 17 and the sheet S2 is denoted by $\mu 5$, the friction may be set so as to establish the relation of $\mu 5>\mu 4>\mu 6$ in the embodiment. With regard to the sheet S1 which is conveyed toward the aligning wall 19, the leading end side is conveyed to the aligning roller 18 and the tail end side is conveyed to the pair of bundle conveying rollers 17. Here, as described above, since $\mu 5$ is set to be larger than $\mu 4$, the conveying velocity of the sheet S1 depends on the rotation velocity of the pair of bundle conveying rollers 17.

Further, after the tail end of the sheet S1 comes out from the pair of bundle conveying rollers 17, the sheet S1 is conveyed farther only by the aligning roller 18 until the leading end bumps into the aligning wall 19.

As in the sheet S1, the sheet S2 and the sheet S3 are also conveyed by the pair of bundle conveying rollers 17 and the aligning roller 18 so as to bump into the aligning wall 19, so that the leading ends of the sheets are aligned. Furthermore, in a case where the number of sheets forming one job is four or more, the fourth sheet and the subsequent sheets are continuously conveyed one by one, and hence the sheets sequentially are superimposed on the preceding conveyed sheet so that the leading ends of the sheets are aligned.

Figure 4B:
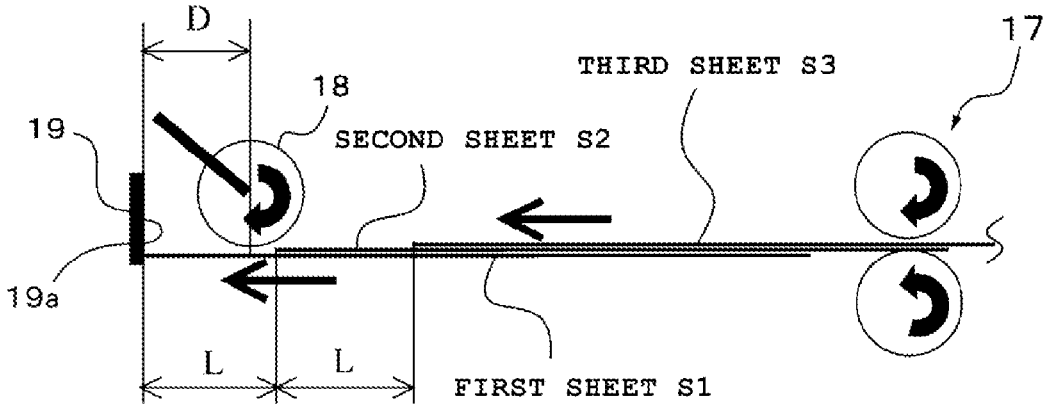
FIG. 4B is a cross-sectional view illustrating a state where the first sheet to the third sheet are shifted by a predetermined shift amount.
Figure 5:
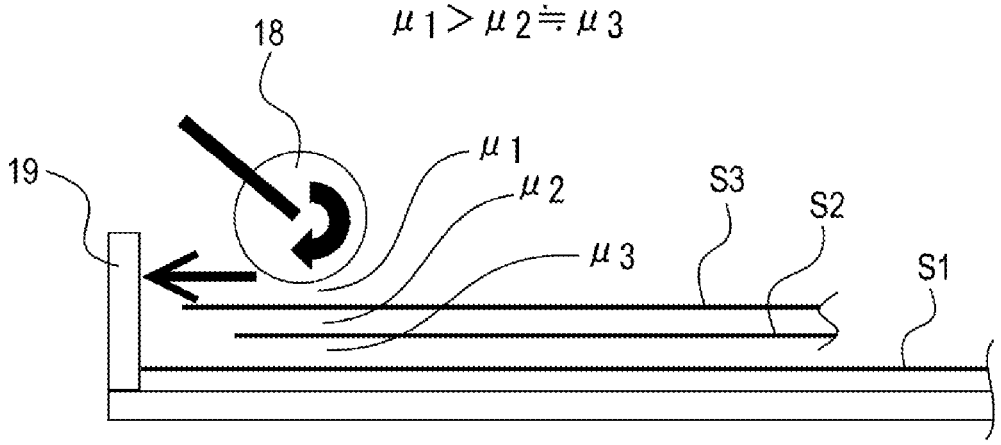
FIG. 5 is a cross-sectional view illustrating a state where the third sheet bumps into the aligning wall before the second sheet bumps into the aligning wall.\

Next, referring to FIG. 4B, the relation between the shift amount of the leading end of the sheet and the arrangement of the aligning roller 18 will be described. FIG. 4B is a cross-sectional view illustrating a state where the first sheet S1 to the third sheet S3 are shifted by a predetermined shift amount L. The reason why the sheets S are superimposed on each other by shifting the leading ends thereof is that the sheets S are sequentially aligned one by one. The sheets S need to come into contact with the aligning roller 18 in an image forming order.

As illustrated in FIG. 4B, the distance from the nip of the aligning roller 18 to the aligning wall 19 is set as the dimension D. Further, the distance between the leading end of the sheet S1 and the leading end of the sheet S2 and the distance between the leading end of the sheet S2 and the leading end of the sheet S3 are set as the shift amount L. In the embodiment, the position of the aligning roller 18 with respect to the aligning wall 19 and the position of the leading end of the sheet which is conveyed by the pair of bundle conveying rollers 17 and is stopped are set so as to establish the relation of the dimension D≤the shift amount L.

Since the shift amount L is set to be larger than the dimension D, the leading end of the sheet S1 conveyed by the aligning roller 18 bumps into the aligning wall 19, and then the leading end of the sheet S2 conveyed to the pair of bundle conveying rollers 17 reaches the front side of the aligning roller 18. At this time, the sheet S3 is also conveyed to the downstream side by the pair of bundle conveying rollers 17 together with the sheet S2. Similarly, the leading end of the sheet S2 conveyed to the aligning roller 18 bumps into the aligning wall 19, and then the leading end of the sheet S3 conveyed to the pair of bundle conveying rollers 17 reaches the front side of the aligning roller 18.

The relation between the dimension D and the shift amount L will be summarized. The distance from the nip portion of the aligning roller 18 to a contact surface 19*a* of the aligning wall 19 in the sheet conveying direction J is denoted by D. The shift amount of the downstream end of the n-th sheet and the downstream end of the n+1-th sheet in the sheet conveying direction J is denoted by L. Then, since the relation between D≤L, the sheets may bump into the aligning wall 19 one by one by the aligning roller 18, and hence the sheets may be reliably aligned. Incidentally, n is an integer of 1 or more.

At this time, when the shift amount L becomes smaller than the dimension D, the subsequent sheet reaches the nip of the aligning roller 18 before the aligning roller 18 allows the preceding sheet to bump into the aligning wall 19. Then, the aligning roller 18 simultaneously conveys two sheets of the preceding sheet and the subsequent sheet, and hence the sheets may not be stably conveyed.

Furthermore, since the apparatus body 100A is formed in a small size, the shift amount L is set as small as possible. In a case where the shift amount L is excessively large, the dimension (particularly in the sheet conveying direction) of the apparatus body 100A increases. That is, when the shift amount L becomes small, the sheet superimposed amount becomes large.

The sheets which are aligned by coming into contact with the aligning wall 19 are stapled by the stapler 27. Then, the aligning wall 19 is retracted, the sheet bundle is discharged to the discharge tray 22 by a conveying unit (not illustrated), and then the process ends.

As described above, according to the configuration of the first embodiment, the number of sheets nipped between the pair of rollers is normally two or less when the sheets are superimposed on each other in a buffering manner (the sheets are temporarily kept so as to wait for the job). Specifically, even when there are the nip portion between the pair of superimposing rollers 14 and the nip portion between the pair of bundle conveying rollers 17, three sheets are not nipped. Accordingly, the sheets may be stably conveyed, and the shift amount of the leading ends of the sheets necessary to be aligned by the aligning roller 18 may be accurately managed. Further, according to the configuration of the first embodiment, the number of sheets nipped between the pair of rollers is two or less and three sheets may be superimposed on each other as illustrated in FIGS. 3 and 4. Accordingly, the sheet superimposed amount may be increased without increasing the size of the apparatus.

Furthermore, in the description of the first embodiment above, a configuration has been described in which the controller 51 stops the lower roller 16 and rotates only the upper roller 15 so as to be superimposed on the sheets, but the invention is not limited thereto. For example, a configuration may be adopted in which the controller 51 stops the upper roller 15 and reversely rotates the lower roller 16 so as to be superimposed on the sheets. Further, even when the lower roller 16 is not stopped, the sheets may be superimposed on each other by rotating the upper roller 15 at the lower speed.

Further, in the description of the first embodiment above, a configuration has been described in which the controller 51 rotates both the upper roller 15 and the lower roller 16 so that the leading end of the sheet reaches the pair of superimposing rollers 14, but the lower roller 16 may not necessarily rotate. In a case of the configuration of stopping the lower roller 16, the friction between the upper roller 15 and the sheet S2 is set to be smaller than the friction between the lower roller 16 and the sheet S1. By this setting, the posture of the sheet S1 may not change at the time of driving the upper roller 15 when the sheet S2 is conveyed into the pair of superimposing rollers 14.

Second Embodiment

Figure 6:
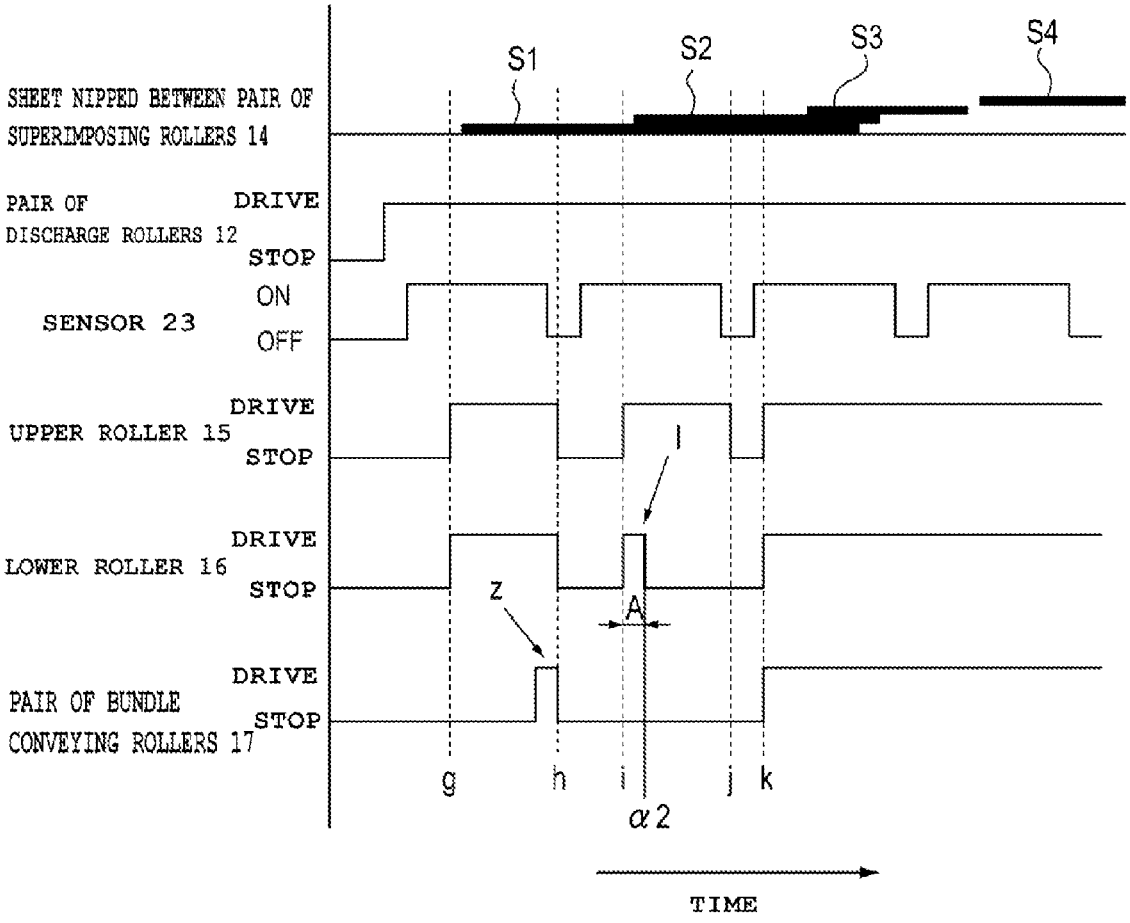
FIG. 6 is a timing chart illustrating a conveying timing at which a sheet nipped between a pair of superimposing rollers according to a second embodiment is conveyed and a driving timing at which a pair of discharge rollers, a sensor, an upper roller, and a lower roller are driven.

Next, a second embodiment will be described. In the description of the second embodiment, the same configuration or the same operation as that of the first embodiment will not be appropriately repeated. FIG. 6 is a timing chart of the second embodiment illustrating a conveying timing at which the sheet nipped between the pair of superimposing rollers 14 is conveyed and a driving timing at which the pair of discharge rollers 12, the sensor 23, the upper roller 15, and the lower roller 16 are driven. In the description of the timing, the timing will be described in order from the timing g to the timing k.

In the first embodiment, a configuration has been described in which the number of sheets nipped between the pair of superimposing rollers 14 is controlled, but in the second embodiment, not only the number of sheets nipped between the pair of superimposing rollers 14 but also the number of sheets nipped between the pair of bundle conveying rollers 17 are controlled. Specifically, in the first embodiment, a configuration has been described in which the number of sheets nipped between the pair of superimposing rollers 14 does not become three, but in the second embodiment, three sheets are temporarily nipped between the pair of superimposing rollers 14 or the pair of bundle conveying rollers 17.

Here, in the second embodiment, when three sheets are nipped between one of the pair of superimposing rollers 14 and the pair of bundle conveying rollers 17, two sheets are nipped between the other of the pair of superimposing rollers 14 and the pair of bundle conveying rollers 17. That is, even in the second embodiment, since three sheets respectively and directly come into contact with the rollers as in the first embodiment, the sheets may be stably conveyed.

Referring to FIG. 6, the control or the like of the second embodiment will be described in detail. The operation and the control until the first sheet S1 conveyed by the pair of discharge rollers 12 is conveyed by a predetermined distance by the pair of superimposing rollers 14 and the driving of the pair of superimposing rollers 14 stops are the same as those of the first embodiment. That is, the timing g of the second embodiment corresponds to the timing a of the first embodiment, and the timing h of the second embodiment corresponds to the timing b of the first embodiment.

Further, the operation and the control until the second sheet S2 is discharged by the pair of discharge rollers 12, is superimposed on the sheet S1, and stops are also the same as those of the first embodiment. That is, the timing i of the second embodiment corresponds to the timing c of the first embodiment, and the timing j of the second embodiment corresponds to the timing d of the first embodiment. Further, the timing $\alpha 2$ of the second embodiment corresponds to the timing $\alpha 1$ of the first embodiment.

Figure 7A:
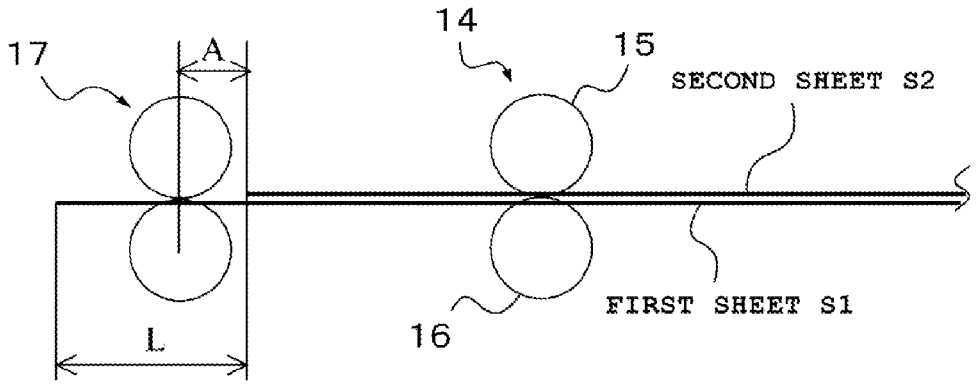
FIG. 7A is a cross-sectional view illustrating a state where a second sheet is conveyed into the pair of superimposing rollers while being superimposed on a first sheet.

FIG. 7A is a cross-sectional view illustrating a state where the second sheet S2 is conveyed into the pair of superimposing rollers 14 while being superimposed on the first sheet S1. As illustrated in FIG. 7A, the sheet S1 and the sheet S2 may be superimposed on each other in a rubbing state just by rotating the upper roller 15. At this time, the lower roller 16 stops while being braked by a torque limiter (not illustrated). Here, the frictional relation between the upper roller 15, the lower roller 16, and the sheet is the same as that of the first embodiment (see FIG. 3A), and the sheet S2 may be conveyed while rubbing the stopped sheet S1.

Since the upper roller 15 is rotated while the controller 51 stops the driving of the lower roller 16 from the timing a2 to the timing j, the sheet S2 may be superimposed on the sheet S1. FIG. 7A illustrates a state of the sheet S1 and the sheet S2 when the controller 51 stops the driving of the upper roller 15 at the timing j.

Figure 7B:
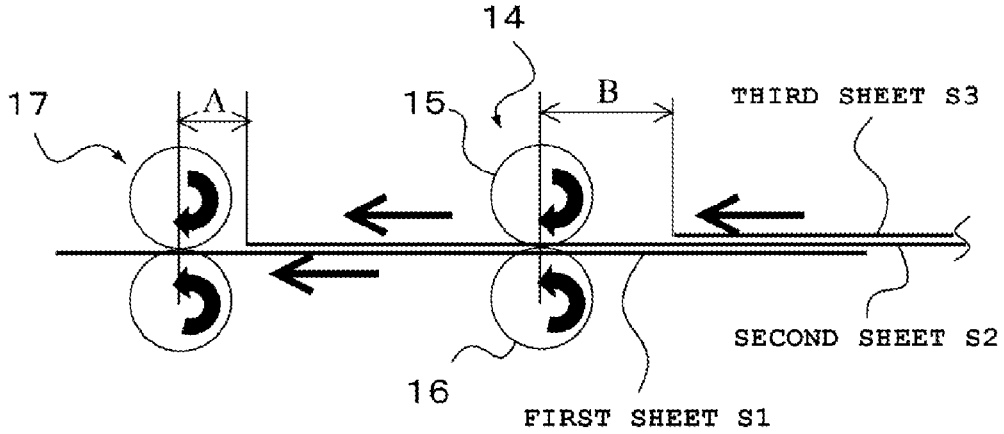
FIG. 7B is a cross-sectional view illustrating a state immediately before a third sheet is conveyed into the pair of superimposing rollers while being superimposed on the second sheet.

Further, the operation and the control in which the sheet S3 discharged by the pair of discharge rollers 12 is conveyed while being nipped between the upper roller 15 and the lower roller 16 are also the same as those of the first embodiment. That is, the timing k of the second embodiment corresponds to the timing e of the first embodiment. FIG. 7B illustrates a state of the sheet S1, the sheet S2 and the sheet S3 when the controller 51 starts the driving of the upper roller 15 and the lower roller 16 at the timing k. At this time, the distance from the leading end of the sheet S2 to the nip portion between the pair of bundle conveying rollers 17 is denoted by A, and the distance from the leading end of the sheet S3 to the nip portion between the pair of superimposing rollers 14 is denoted by B. That is, when the leading end of the sheet S3 conveyed by the pair of discharge rollers 12 is conveyed to the upstream position in the sheet conveying direction J by the dimension B in relation to the nip between the pair of superimposing rollers 14, the driving of the upper roller 15 and the lower roller 16 is started again (see the timing k).

Figure 7C:
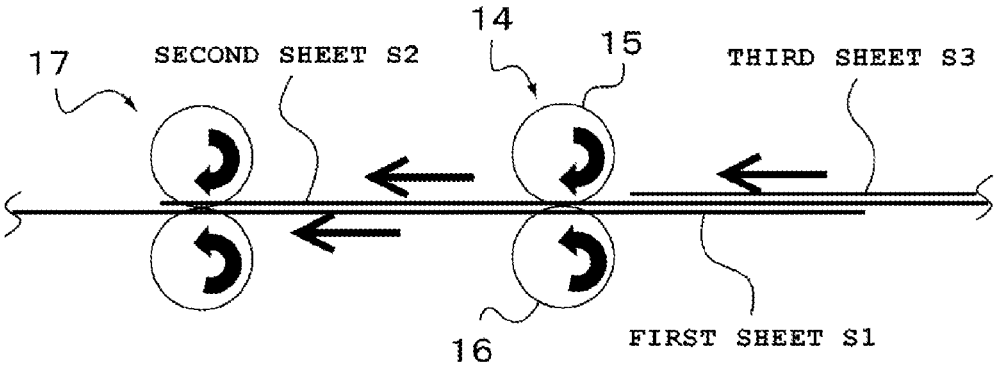
FIG. 7C is a cross-sectional view illustrating a state immediately before the third sheet is conveyed into the pair of superimposing rollers while being superimposed on the second sheet.

In the second embodiment, the controller 51 starts the driving of the pair of superimposing rollers 14 at the timing k and also starts the driving of the pair of bundle conveying rollers 17. Furthermore, at this time, the pair of superimposing rollers 14 and the pair of bundle conveying rollers 17 have the same circumferential velocity. FIG. 7C is a diagram illustrating a state of the sheets S1, S2, and S3 after a predetermined time elapses from the time at which the driving of the pair of superimposing rollers 14 and the pair of bundle conveying rollers 17 starts at the timing k. Since the dimension A is shorter than the dimension B in FIG. 7B, the leading end of the sheet S2 reaches the nip portion between the pair of bundle conveying rollers 17 before the leading end of the sheet S3 reaches the nip portion between the pair of superimposing rollers 14.

In contrast, when the dimension A is longer than the dimension B in FIG. 7B, the sheet S3 reaches the nip portion between the pair of superimposing rollers 14 before the leading end of the sheet S2 reaches the nip portion between the pair of bundle conveying rollers 17. Then, the sheet S2 does not directly come into contact with any one of the pair of superimposing rollers 14 and the pair of bundle conveying rollers 17, and the accuracy in the conveying of the sheet is degraded.

Figure 8A:
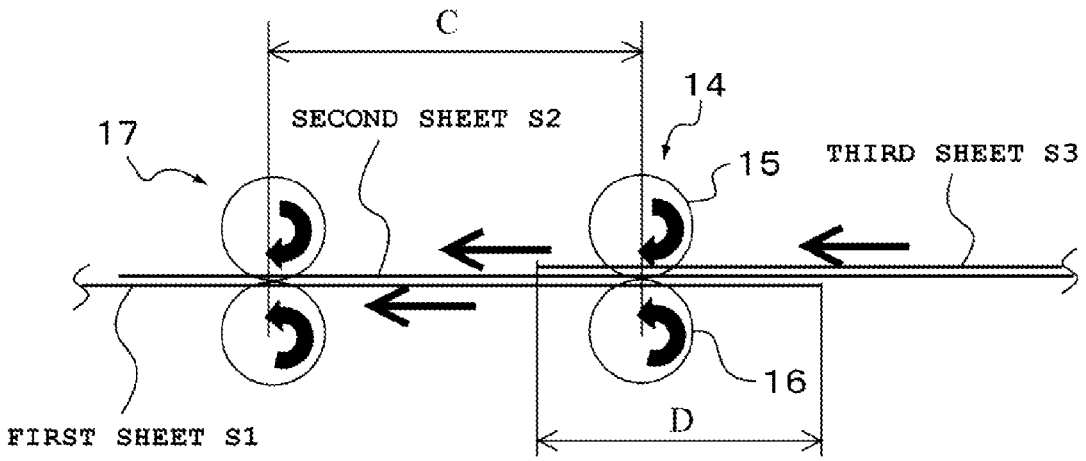
FIG. 8A is a cross-sectional view illustrating a state where the first sheet to the third sheet are superimposed on each other and are conveyed into the pair of superimposing rollers.

FIG. 8A is a diagram illustrating a state of the sheets S1, S2, and S3 when a predetermined time further elapses from the state illustrated in FIG. 7C. The leading end of the sheet S3 reaches the nip portion between the pair of superimposing rollers 14, and three sheets of the sheets S1, S2, and S3 are nipped between the pair of superimposing rollers 14. In the state of FIG. 8A, three sheets are nipped between the pair of superimposing rollers 14, but since the number of sheets nipped between the pair of bundle conveying rollers 17 is two or less, three sheets all come into contact with the respective rollers. Specifically, in the state of FIG. 8A, the sheet S1 comes into contact with the lower roller of the pair of bundle conveying rollers 17, the sheet S2 comes into contact with the upper roller of the pair of bundle conveying rollers 17, and the sheet S3 stably comes into contact with the upper roller 15. Accordingly, the sheets may be stably conveyed.

Further, in FIG. 8A, the gap from the nip portion between the pair of superimposing rollers 14 to the nip portion between the pair of bundle conveying rollers 17 is set as the dimension C and the length of the sheet S1 and the sheet S3 superimposed on each other in the sheet conveying direction is set as the dimension D. The dimension D is a distance between the leading end of the sheet S3 and the tail end of the sheet S1.

Figure 8B:
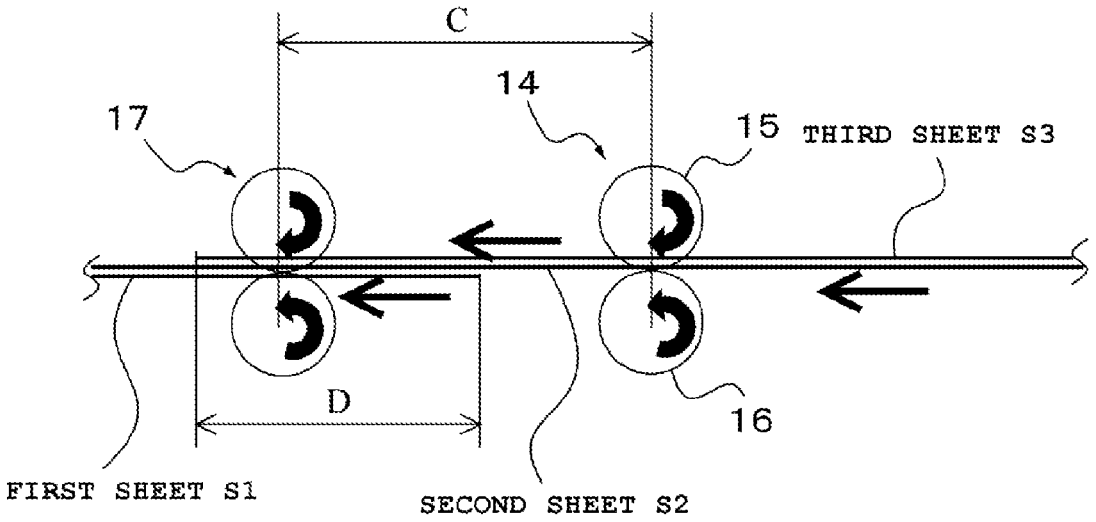
FIG. 8B is a cross-sectional view illustrating a state where the first sheet to the third sheet are conveyed into the pair of bundle conveying rollers while being superimposed on each other.

In the second embodiment, since the dimension C is set to be longer than the dimension D, when the leading end of the sheet S3 reaches the nip portion between the pair of bundle conveying rollers 17 as illustrated in FIG. 8B, the tail end of the sheet S1 passes the nip portion between the pair of superimposing rollers 14. Accordingly, in the state of FIG. 8B, three sheets are nipped between the pair of bundle conveying rollers 17, but since the number of sheets nipped between the pair of superimposing rollers 14 is two or less, three sheets all come into contact with the respective rollers. Specifically, in the state of FIG. 8B, the sheet S1 comes into contact with the lower roller of the pair of bundle conveying rollers 17, the sheet S2 comes into contact with the lower roller 16, and the sheet S3 comes into contact with the upper roller 15.

In contrast, when the relation of the dimension C the dimension D is set, three sheets of the sheet S1, the sheet S2, and the sheet S3 may be simultaneously nipped between both the pair of bundle conveying rollers 17 and the pair of superimposing rollers 14. Then, the sheet S2 is nipped between the sheet S1 and the sheet S3, and may not come into contact with any roller. For this reason, the accuracy in the conveying of the sheet S2 is degraded. The operation after FIG. 8B is the same as that of the first embodiment, and hence the description thereof will not be repeated.

As described above, according to the sheet processing apparatus of the embodiment, since three sheets respectively come into contact with any roller of the pair of superimposing rollers 14 or the pair of bundle conveying rollers 17 when superimposing three sheets on each other, the sheets may be stably conveyed.

Further, in the second embodiment, since three sheets may be superimposed on each other in an overlapping manner in the range of the dimension D, much buffer time may be saved.

Further, since the sheet leading end shift amount necessary for aligning the sheets by the aligning roller 18 may be accurately managed as in the first embodiment, a reliable aligning operation and a decrease in the size of the apparatus may be realized.

Third Embodiment

Figure 9:
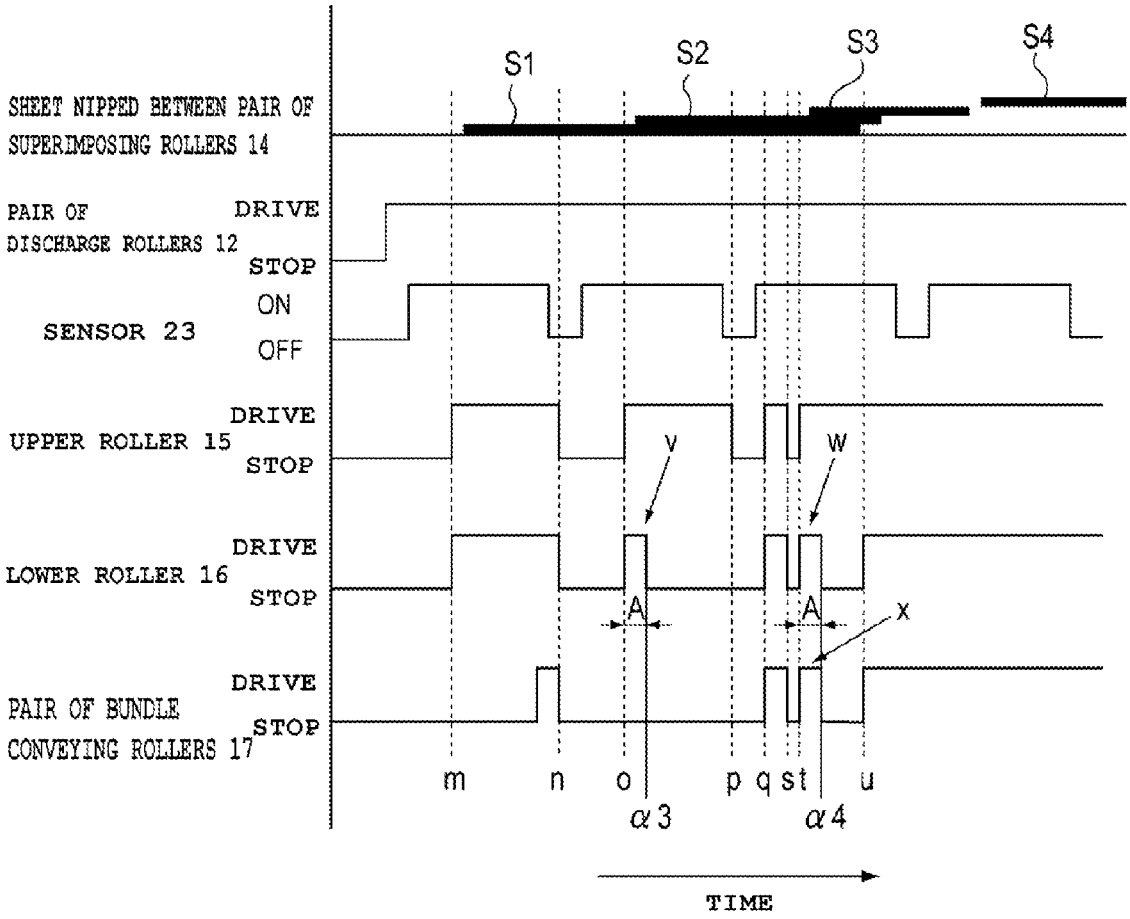
FIG. 9 is a timing chart illustrating a conveying timing at which a sheet nipped between a pair of superimposing rollers according to a third embodiment is conveyed and a driving timing at which a pair of discharge rollers, a sensor, an upper roller, and a lower roller are driven.

Next, a third embodiment will be described. In the description of the third embodiment, the same configuration or the same operation as that of the first embodiment will not be appropriately repeated. FIG. 9 is a timing chart illustrating a conveying timing at which the sheet nipped between the pair of superimposing rollers 14 according to the third embodiment is conveyed and a driving timing at which the pair of discharge rollers 12, the sensor 23, the upper roller 15, and the lower roller 16 are driven. In the description of the timing, the timing will be described in order from the timing m to the timing u.

In the second embodiment, a control has been described in which the number of sheets nipped between the pair of bundle conveying rollers 17 or the pair of superimposing rollers 14 is three. The third embodiment is characterized in that the length of three sheets superimposed in the sheet conveying direction J further increases.

Hereinafter, referring to FIGS. 9 and 10, the configuration and the operation of the third embodiment will be described. Particularly, the third embodiment has a characteristic in the arrangement of the pair of bundle conveying rollers 17 and the pair of superimposing rollers 14, and the gap between the pair of bundle conveying rollers 17 and the pair of superimposing rollers 14 will be described later in detail.

The operation and the control until the first sheet S1 conveyed by the pair of discharge rollers 12 is conveyed by a predetermined distance by the pair of superimposing rollers 14 and the driving of the pair of superimposing rollers 14 is stopped are the same as those of the first and second embodiments. That is, the timing m of the third embodiment corresponds to the timing a of the first embodiment, and the timing n of the third embodiment corresponds to the timing b of the first embodiment.

Further, the operation and the control until the sheet S2 is discharged by the pair of discharge rollers 12, is superimposed on the sheet S1, and is stopped are also the same as those of the first and second embodiments. That is, the timing o of the third embodiment corresponds to the timing c of the first embodiment, and the timing p of the third embodiment corresponds to the timing d of the first embodiment. Further, the timing a3 of the third embodiment corresponds to the timing a1 of the first embodiment.

Since the controller 51 rotates the upper roller 15 while stopping the driving of the lower roller 16 from the timing a3 to the timing p, the sheet S2 may be superimposed on the sheet S1. This operation is also the same as those of the first and second embodiments.

Subsequently, the controller 51 drives the upper roller 15, the lower roller 16, and the pair of bundle conveying rollers 17 which are stopped (see the timing q), and immediately stops them (see the timing s). Accordingly, the sheet S1 and the sheet S2 are conveyed to the downstream, and the tail end of the sheet S2 passes the nip portion between the pair of superimposing rollers 14 as illustrated in FIG. 10A.

Figure 10A:
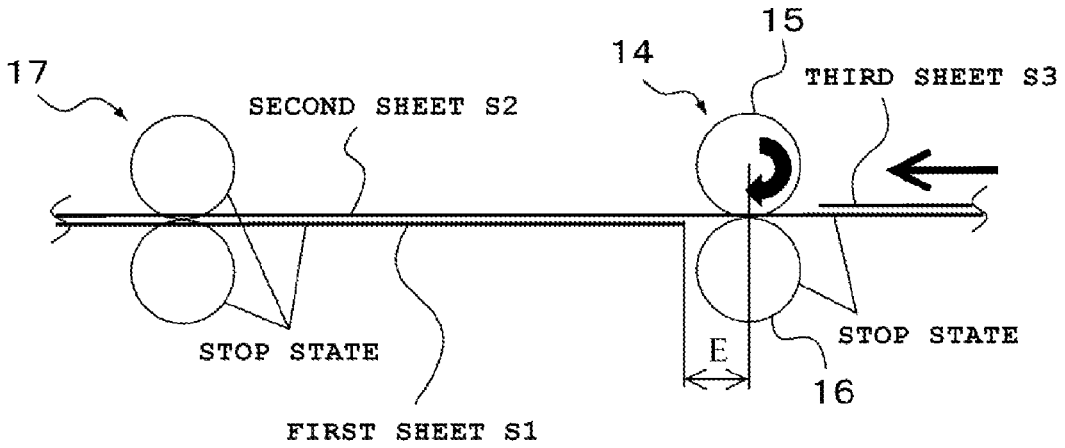
FIG. 10A is a cross-sectional view illustrating a state immediately before a third sheet is conveyed into the pair of superimposing rollers while being superimposed on a second sheet.

Furthermore, at this time, the leading end of the sheet S2 reaches the nip portion between the pair of bundle conveying rollers 17 and is nipped between the pair of bundle conveying rollers 17 as illustrated in FIG. 10A, but this is not important in the second embodiment. That is, the leading end of the sheet S2 may not reach the nip portion between the pair of bundle conveying rollers 17 at the timing s.

Subsequently, the controller 51 drives the upper roller 15 and the lower roller 16 before the leading end of the sheet S3 conveyed by the pair of discharge rollers 12 reaches the nip portion between the pair of superimposing rollers 14 (see the timing t). The timing t of the third embodiment corresponds to the timing e of the first embodiment. Accordingly, the sheet S3 is conveyed into the nip portion between the pair of superimposing rollers 14 along the front surface of the sheet S2. Further, the controller 51 also drives the pair of bundle conveying rollers 17 (the timing t).

Subsequently, the controller 51 stops the driving of the lower roller 16 and the pair of bundle conveying rollers 17 (see the timing a4). Accordingly, since only the upper roller 15 is driven, the sheet S3 is conveyed by the upper roller 15 so as to be superimposed on the sheet S2.

Figure 10B:
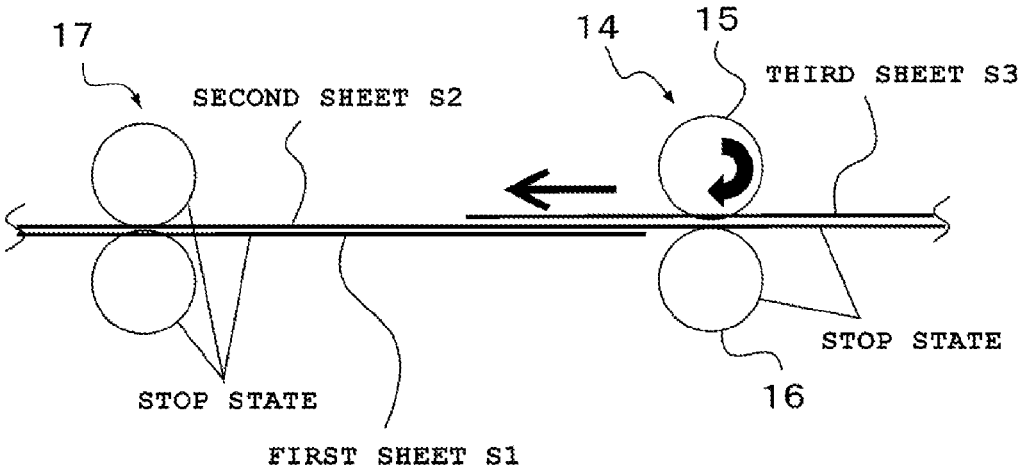
FIG. 10B is a cross-sectional view illustrating a state where the third sheet is conveyed into the pair of superimposing rollers while being superimposed on the second sheet.

After the sheet S3 is nipped between the pair of superimposing rollers 14, the controller 51 stops the driving of the lower roller 16 (the timing $\alpha$4) and drives only the upper roller 15. In this way, the sheet S3 is conveyed by the upper roller 15 and is superimposed on the sheet S2 from the timing $\alpha$4 to the timing u. FIG. 10B is a diagram illustrating a moment from the timing $\alpha$4 to the timing u, and illustrates a state where the sheet S3 is superimposed on the sheet S2 by the upper roller 15. Furthermore, as illustrated in FIG. 10B, the sheet S2 already reaches the nip between the pair of bundle conveying rollers 17.

Before the leading end of the sheet S3 conveyed by the upper roller 15 reaches the nip portion between the pair of bundle conveying rollers 17, the controller 51 drives the lower roller 16 and the pair of bundle conveying rollers 17 (see the timing u). In the description of the third embodiment above, the sheet S3 is nipped between the pair of superimposing rollers 14, and the driving of the upper roller 15 does not stop. However, in a case where the more standby time needs to be saved, the driving of the upper roller 15 may be stopped after the sheet S3 is nipped between the pair of superimposing rollers 14. Furthermore, although it is also illustrated in the timing chart of FIG. 9, in a case where the fourth sheet and the subsequent sheets move to the pair of superimposing rollers 14, the driving state of the upper roller 15 and the lower roller 16 is continued.

Figure 11A:
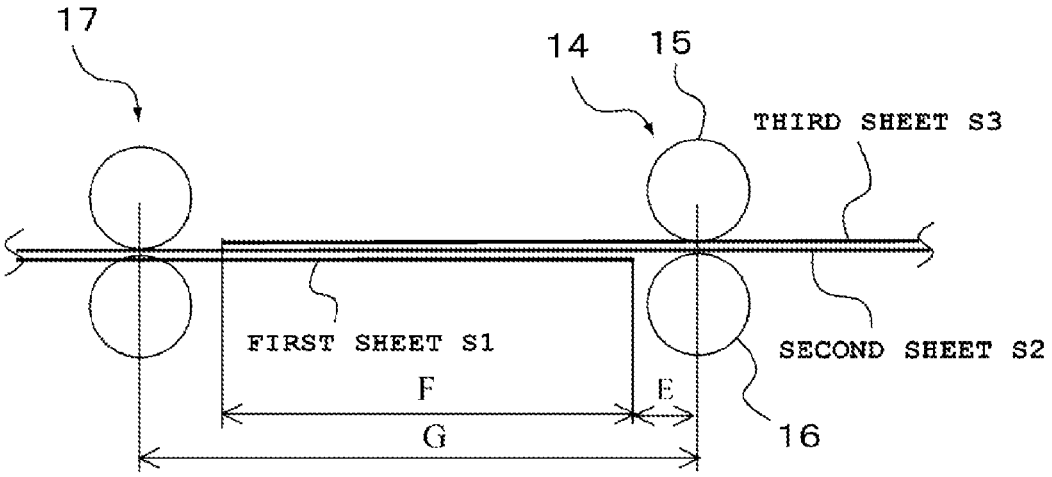
FIG. 11A is a cross-sectional view illustrating a state where the third sheet is conveyed into the pair of superimposing rollers while being superimposed on the second sheet.

FIG. 11A is a diagram illustrating a state of the sheet S1, the sheet S2, and the sheet S3 before the driving of the lower roller 16 and the pair of bundle conveying rollers 17 is started at the timing u. The distance between the nip portion between the pair of bundle conveying rollers 17 and the nip portion between the pair of superimposing rollers 14 is set as the dimension G. The dimension F is the distance between the leading end of the sheet S3 and the tail end of the sheet S1, and the length in which three sheets are all superimposed on each other. The dimension E is the distance between the tail end of the sheet S1 and the nip between the pair of superimposing rollers 14. Furthermore, the position of the leading end of the sheet S3 when the driving of the lower roller 16 and the pair of bundle conveying rollers 17 is started at the timing u is controlled by the pair of discharge rollers 12 in response to the detection result of the sensor 23.

Here, in order to obtain the longest buffer time, there is a need to increase a region in which three sheets are superimposed on each other. Specifically, when the dimension E is set to be small and the dimension G is set to be large as illustrated in FIG. 11A, the dimension F may be increased, and hence the region in which three sheets are superimposed on each other may be made large.

Figure 11B:
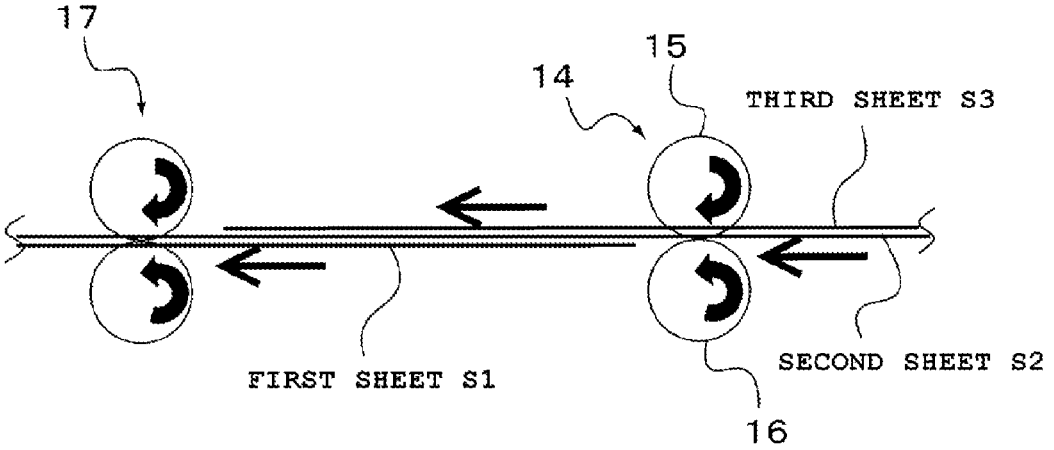
FIG. 11B is a cross-sectional view illustrating a state where all sheets respectively come into contact with rollers when the sheets are conveyed out.

In this way, the controller 51 discharges the sheet bundle to the aligning wall 19 by rotationally driving the pair of superimposing rollers 14 and the pair of bundle conveying rollers 17 after superimposing three sheets on each other (see the timing u). As illustrated in FIG. 11B, all sheets respectively come into contact with the respective rollers when discharging the sheets, and hence the sheets may be stably conveyed.

The subsequent operations are the same as those of the first embodiment. As described above, according to the sheet processing apparatus of the embodiment, since three sheets respectively and directly come into contact with any roller of the pair of superimposing rollers 14 or the pair of bundle conveying rollers 17 when superimposing three sheets on each other, the sheets may be stably conveyed.

According to the sheet processing apparatus of the embodiment, since three sheets respectively and directly come into contact with any roller of the pair of superimposing rollers 14 or the pair of bundle conveying rollers 17 when superimposing three sheets on each other, the sheets may be stably conveyed.

Further, in the third embodiment, since the overlapping amount of the sheet S3 may be made large compared to the second embodiment, the longer buffer time may be obtained, and hence this is advantageous in an increase in speed of the operation. Further, since the sheet leading end shift amount necessary for aligning the sheets by the aligning roller 18 may be accurately managed as in the first embodiment, a reliable aligning operation and a decrease in the size of the apparatus may be realized.

Fourth Embodiment

Figure 12:
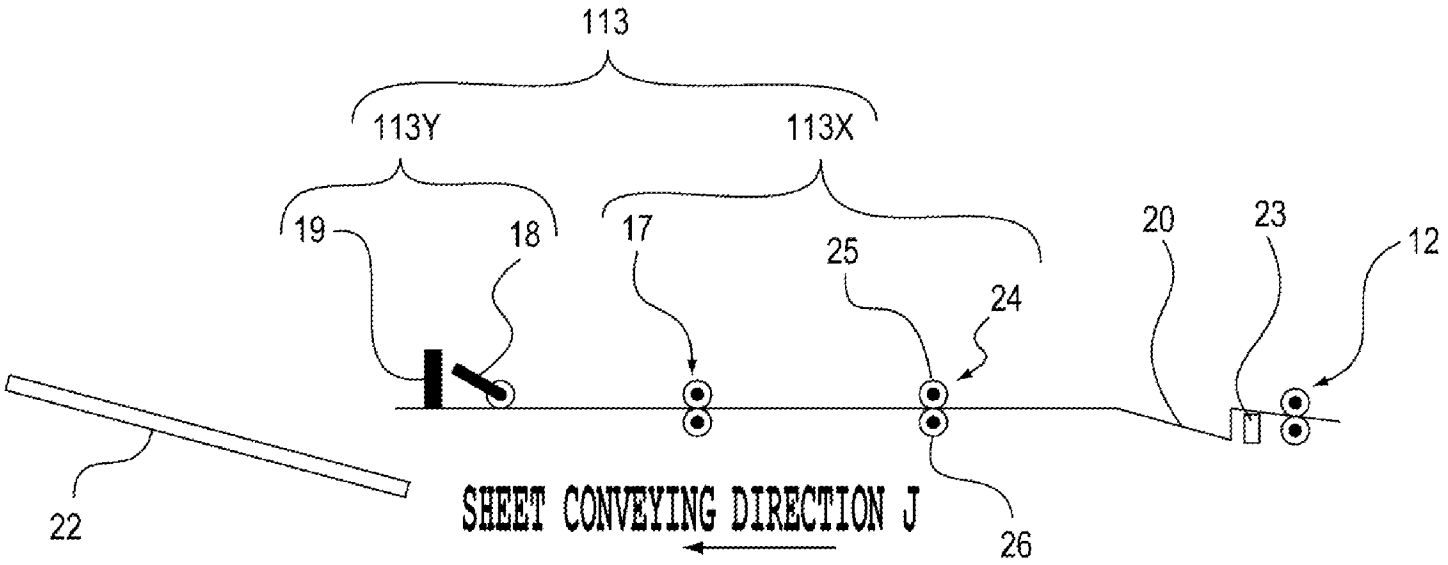
FIG. 12 is an enlarged cross-sectional view illustrating a configuration of a sheet processing system according to a fourth embodiment.

Next, a fourth embodiment will be described. In the description of the fourth embodiment, the same configuration or the same operation as that of the first embodiment will not be appropriately repeated. FIG. 12 is an enlarged cross-sectional view illustrating a configuration of the sheet processing apparatus 113 according to the fourth embodiment. Hereinafter, the configuration and the operation of the sheet processing apparatus 113 of the fourth embodiment will be described.

Figure 13:
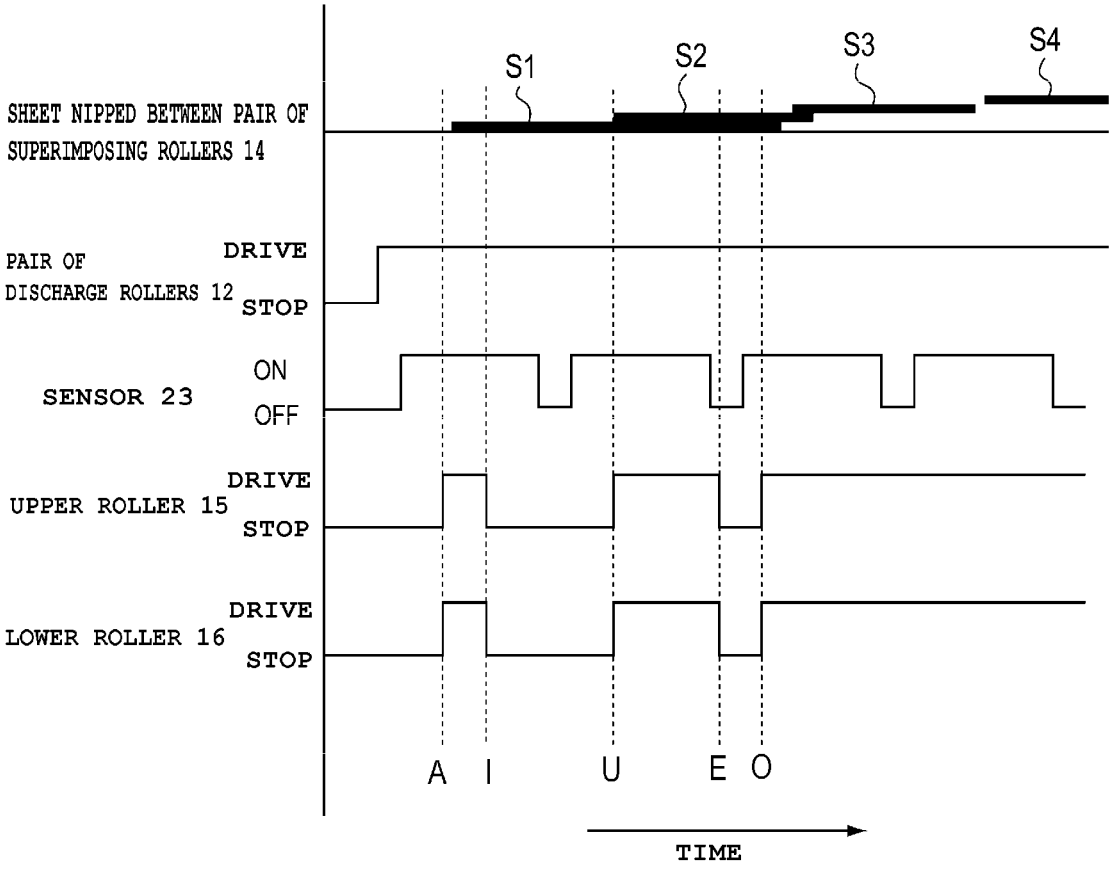
FIG. 13 is a timing chart illustrating a conveying timing at which a sheet nipped between a pair of superimposing rollers is conveyed and a driving timing at which a pair of discharge rollers, a sensor, an upper roller, and a lower roller are driven.

FIG. 13 is a timing chart illustrating a conveying timing at which the sheet nipped between the pair of superimposing rollers 24 is conveyed and a driving timing at which the pair of discharge rollers 12, the sensor 23, the upper roller 25, and the lower roller 26 are driven. These members are controlled by the controller 51.

When the sheet S1 is discharged from the pair of discharge rollers 12, the sheet is conveyed while being nipped between the pair of superimposing rollers 24. The controller 51 drives the upper roller 25 and the lower roller 26 so that the rollers rotate at the same circumferential velocity in the opposite directions (see the timing "A"). That is, the upper roller 25 and the lower roller 26 move in the same direction at the nip portion, and both rollers rotate in a direction facing the sheet conveying direction J. For example, when the upper roller 25 may rotate in the positive direction, the lower roller 26 may rotate in the reverse direction.

The controller 51 stops both the upper roller 25 and the lower roller 26 after the tail end of the sheet S1 comes out from the pair of discharge rollers 12 (see the timing "I"). In this way, the sheet S1 is maintained to be nipped between the pair of superimposing rollers 24. Furthermore, the stop position of the sheet S1 is controlled based on the time at which the tail end of the sheet S1 passes by the sensor 23, and is set as a position where the tail end of the sheet S1 slightly passes by the step 20 (see FIG. 1). Furthermore, the sheet does not need to be necessarily stopped. For example, the sheet may be just decelerated and may be stopped by a short time after the deceleration.

Subsequently, the sheet S2 is discharged from the pair of discharge rollers 12, and is conveyed into the pair of superimposing rollers 24. The pair of superimposing rollers 24 maintains the stop state or the deceleration state until the sheet S2 reaches the rollers, and the driving thereof is started again immediately before or immediately after the sheet S2 reaches the rollers (see the timing "U"), so that the sheet S1 and the sheet S2 are conveyed while being superimposed on each other. In this way, even when the sheet S2 is conveyed while being superimposed on the sheet S1, the lower roller 26 rotates along with the upper roller 25 at the moment when both sides of the sheet S2 are nipped or after the moment. This point is different from the control of the first embodiment.

Figure 14A:
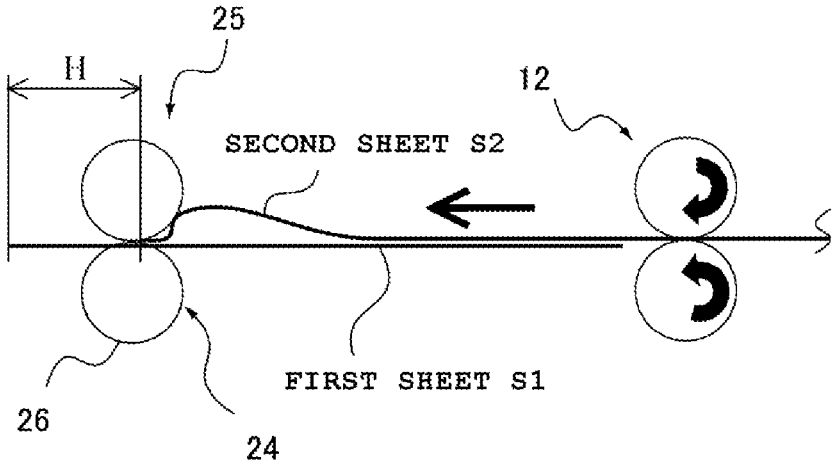
FIG. 14A is a cross-sectional view illustrating a timing at which a leading end of a second sheet comes into contact with a pair of superimposing rollers so as to form a small loop and the driving of the pair of superimposing rollers is started again.

FIG. 14A is a cross-sectional view illustrating a timing at which the leading end of the sheet S2 comes into contact with the pair of superimposing rollers 24 so as to form a small loop and the driving of the pair of superimposing rollers 24 is started again. As illustrated in FIG. 14A, the sheet S2 is conveyed while being nipped between the pair of discharge rollers 12 to a position where the sheet S1 stops while being nipped between the pair of superimposing rollers 24. At this time, the leading end of the sheet S2 reaches the nip between the upper roller 25 and the lower roller 26, and the skew feeding is corrected. According to such a control, the shift amount of the leading end of the sheet S2 may be accurately aligned, which is effective for the skew feeding (skew).

Furthermore, in the fourth embodiment, the pair of superimposing rollers 24 is disposed at a position away from the pair of discharge rollers 12 compared to the configuration of the first embodiment. The reason is as below. In the first embodiment, the shift amount in the conveying direction when superimposing two sheets on each other is controlled in a manner such that the controller 51 rotates only the upper roller 15 while the lower roller 16 is stopped so as to superimpose the sheet S2 on the sheet S1.

On the other hand, in the fourth embodiment, the controller 51 does not perform control in which only the upper roller 25 is rotated while the lower roller 26 is stopped. That is, in the fourth embodiment, no relative velocity difference occurs between the sheets S1 and S2 after the sheet S2 is conveyed into the pair of superimposing rollers 24. That is, the shift amount in the conveying direction when superimposing two sheets on each other becomes the distance from the nip between the pair of superimposing rollers 24 to the downstream end of the sheet S1 in the conveying direction at the position where the sheet S1 is stopped at the timing. Accordingly, since the shift amount of two sheets is obtained as small as possible, there is a need to set a comparatively long distance between the pair of superimposing rollers 24 and the pair of discharge rollers 12 in consideration of the length of the sheet. Due to the above-described reason, in the fourth embodiment, the distance between the pair of superimposing rollers 24 and the pair of discharge rollers 12 is set to be longer than that of the first embodiment.

After the sheet S1 and the sheet S2 are superimposed on each other, the pair of superimposing rollers 24 may not be stopped and convey a bundle of two sheets to the aligning wall 19 at the downstream in the sheet conveying direction J. Alternatively, in order to perform the buffer, as illustrated in the timing chart of FIG. 13, the upper roller 25 and the lower roller 26 may be first stopped (see the timing "E" of FIG. 13) or be decelerated.

Figure 14B:
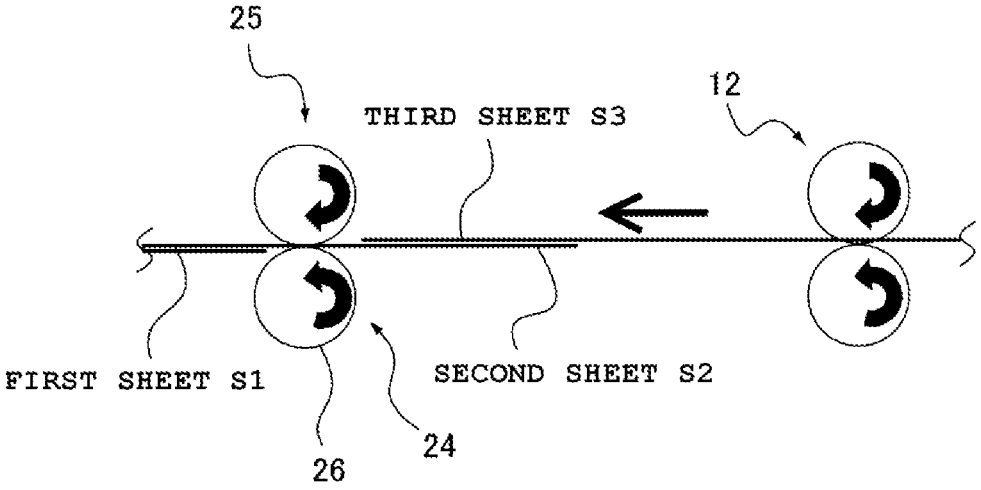
FIG. 14B is a cross-sectional view illustrating a state where a leading end of a third sheet is conveyed into the pair of superimposing rollers.

FIG. 14B is a cross-sectional view illustrating a state where the leading end of the third sheet S3 is conveyed into the pair of superimposing rollers 24. Referring to FIG. 14B, the operation in a case where the pair of superimposing rollers 24 is stopped again will be described below. The conveying of the sheet S1 and the sheet S2 is started as a bundle in a superimposed state by starting the driving of the pair of superimposing rollers 24 before the timing at which the sheet S3 is conveyed into the pair of superimposing rollers 24 (see the timing "O" of FIG. 13). Then, when the leading end of the sheet S3 is conveyed into the pair of superimposing rollers 24, the tail end of the sheet S1 is discharged from the pair of superimposing rollers 24 (see FIG. 14B).

In this way, even in a state where three sheets are superimposed on each other, the number of sheets nipped between the pair of superimposing rollers 24 may be two or less at all times. For this reason, any sheet may be stably conveyed. The reason why the sheets may be stably conveyed when the number of nipped sheets is two or less is the same as that of the first embodiment.

After the sheet S3 is conveyed into the pair of superimposing rollers 24, all sheets are discharged without stopping the rotational driving of the pair of superimposing rollers 24. The subsequent operations are the same as those of the first embodiment.

As described above, since three sheets may be superimposed on each other so as not to overlap each other by using the sheet processing apparatus of the image forming apparatus according to the embodiment, the sheets may be stably conveyed. Further, in the fourth embodiment, since the sheet leading end shift amount necessary for aligning the sheets by the aligning roller 18 may be accurately managed, the reliable aligning operation and a decrease in the size of the apparatus may be realized. In the fourth embodiment, there is no need to provide a configuration of a clutch or a torque limiter for rotating the upper roller 25 while the lower roller 26 is stopped. Further, in the fourth embodiment, since the operation in which the sheets are superimposed on each other just by rotating the upper roller 25 is not performed, there is a low possibility of a defective image when superimposing the sheets on each other.

Hereinafter, the analysis of the effects of the first to fourth embodiments will be summarized.

According to the configuration of the first embodiment or the fourth embodiment, the following effects may be obtained. The controller 51 drives the pair of superimposing rollers 14 so that the upstream end of the first sheet S1 in the sheet conveying direction J comes out from the nip between the pair of superimposing rollers 14 before the downstream end of the third sheet S3 in the sheet conveying direction J reaches the pair of superimposing rollers 14. Accordingly, in a case where three sheets are conveyed in a superimposed state, the first sheet S1 and the third sheet S3 are conveyed as a bundle while being superimposed on each other and being shifted in the sheet conveying direction J so as not to overlap each other. For this reason, the pair of superimposing rollers 14 always nips two or less sheets, and at this time, three sheets all respectively and directly come into contact with the pair of superimposing rollers 14 while the sheets are conveyed. As a result, the superimposed sheets are conveyed as a bundle with high precision, and the shift amount or the shift direction of the superimposed sheets may be managed.

According to the configuration of the second embodiment or the third embodiment, the pair of bundle conveying rollers 17 nips the sheet S2, and then the pair of superimposing rollers 14 nips the sheet S3. Accordingly, in a case where three sheets are conveyed in a superimposed state, even when the pair of superimposing rollers 14 nips three sheets of the first sheet to the third sheet, the pair of bundle conveying rollers 17 nips only two sheets of the first sheet S1 and the second sheet S2. At this time, three sheets all directly come into contact with any roller of the pair of superimposing rollers 14 and the pair of bundle conveying rollers 17. As a result, the superimposed sheets are conveyed as a bundle with high precision, and hence the shift amount or the shift direction of the superimposed sheets may be managed.

According to the configuration of the first embodiment or the third embodiment, it is controlled so that the first sheet S1 comes out from the pair of superimposing rollers 14 before the pair of superimposing rollers 14 nips the third sheet S3. For this reason, even when three sheets are conveyed in a superimposed state, the pair of superimposing rollers 14 always nips only two or less sheets. As a result, all sheets are conveyed while coming into contact with the upper roller 15 or the lower roller 16 of the pair of superimposing rollers 14.

According to the configuration of the second embodiment, the following effects may be obtained. In a case where three sheets are conveyed in a superimposed state, even when the pair of bundle conveying rollers 17 nips three sheets of the first sheet to the third sheet in an overlapping state, the pair of superimposing rollers 14 nips only two sheets of the second sheet S2 and the third sheet S3. At this time, three sheets all directly come into contact with any roller of the pair of superimposing rollers 14 and the pair of bundle conveying rollers 17. As a result, the superimposed sheets are conveyed as a bundle with high precision, and hence the shift amount or the shift direction of the superimposed sheets may be managed.

According to the configuration of the third embodiment, the controller 51 performs control so that the pair of superimposing rollers 14 decelerates the first sheet S1 and the second sheet S2 in a nipping state and the pair of discharge rollers 12 conveys the third sheet in a nipping state. Accordingly, it is possible to increase a region in which the third sheet further overlaps a region in which the first sheet S1 and the second sheet S2 are superimposed on each other. For this reason, it is possible to increase a region in which the first sheet S1 to the third sheet S3 overlap each other. As a result, the much buffer time may be made, and the high output speed may be handled.

According to the configurations of the first to third embodiments, in a state where the rotation velocity of the upper roller 15 is fast and the rotation velocity of the lower roller 16 is slow, the second sheet S2 may easily slide on the first sheet S1.

According to the configuration of the fourth embodiment, the lower roller 16 and the upper roller 15 rotate at the same rotation velocity so as to rotate in the opposite directions. As a result, the register-correction is performed in a manner such that the second sheet S2 superimposed on the first sheet S1 in a shifted state forms a loop. Further, the register-correction is performed in a manner such that the third sheet S3 superimposed on the second sheet S2 in a shifted state forms a loop.

According to the configurations of the first to fourth embodiments, the aligning roller 18 and the aligning wall 19 are provided. For this reason, the plurality of sheets is conveyed as a bundle while the shift amount is managed with high precision. As a result, in order to align the leading ends of the plurality of sheets, the shift amount which is minimally required is set. As a result, compared to the buffer mechanism in which the sheet is wound on the large roller of the related art, it is possible to realize a decrease in size and prevent degradation in the process yield caused by a difference in the length of the sheet in the sheet conveying direction or a decrease in the gap between the sheets.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures and functions.

This application claims the benefit of Japanese Patent Application No. 2011-221742, filed Oct. 6, 2011, which is hereby incorporated by reference herein in its entirety.

The invention claimed is:

1. A sheet processing apparatus comprising:

a conveying unit which conveys sheets in order from a first sheet, a second sheet, and a third sheet;

a pair of conveying rollers which is provided downstream of the conveying unit in a sheet conveying direction and conveys the sheets while nipping the sheets at a nip portion;

a superimposing unit which is provided between the conveying unit and the pair of conveying rollers and superimposes a subsequent sheet on a preceding sheet in the sheet conveying direction, the superimposing unit being configured to superimpose the second sheet on the first sheet and superimpose the third sheet on the second sheet;

a control unit which controls a rotation of the pair of conveying rollers; and an aligning portion provided downstream of the pair of conveying rollers in the sheet conveying direction and against which a leading end in the sheet conveying direction of a conveyed sheet abuts, wherein the control unit controls the rotation of the pair of conveying rollers so that a tail end of the first sheet passes the nip portion of the pair of conveying rollers by conveying the first sheet to a downstream side before a leading end of the third sheet superimposed on the second sheet reaches the nip portion between the pair of conveying rollers nipping the first sheet and the second sheet superimposed on the first sheet, and wherein a sheet bundle having an aligned leading end is formed by abutting a leading end of each one of a plurality of sheets against the aligning portion.

2. The sheet processing apparatus according to claim 1, wherein the superimposing unit includes a step which is installed in a conveying path between the conveying unit and the pair of conveying rollers, wherein the subsequent sheet conveyed by the conveying unit is superimposed on the preceding sheet on the step.

3. The sheet processing apparatus according to claim 1, wherein the pair of conveying rollers includes an upper roller and a lower roller, and wherein when the pair of conveying rollers nips two sheets, the control unit controls a driving of a driving unit so that either an upper sheet or a lower sheet nipped between the pair of conveying rollers is conveyed by rotating either the upper roller or the lower roller.

4. The sheet processing apparatus according to claim 3, further comprising:

a brake unit which decelerates or stops a rotation of the upper roller or the lower roller when either the upper roller or the lower roller rotates.

5. The sheet processing apparatus according to claim 1, further comprising:

an aligning roller which is provided between the pair of conveying rollers and the aligning portion and conveys the sheets so that the sheets abut against the aligning portion.

6. The sheet processing apparatus according to claim 5, wherein when a distance in a sheet conveying direction between a contact surface of the aligning portion and a nip of the aligning roller is denoted by D and a shift amount in the sheet conveying direction between a downstream end of the preceding sheet in the sheet conveying direction and a downstream end of the subsequent sheet in the sheet conveying direction is denoted by L, D and L have a relation of $D \leq L$.

7. An image forming apparatus comprising:

an image forming portion which forms an image on a sheet; and the sheet processing apparatus of claim 1 which processes the sheet having the image formed thereon.

8. The sheet processing apparatus according to claim 1, further comprising:

a processing unit configured to process the sheet bundle.

9. The sheet processing apparatus according to claim 8, wherein the processing unit is a stapler which staples the sheet bundle whose leading end is aligned.

10. The sheet processing apparatus according to claim 9, wherein the aligning portion retracts from the sheet bundle after the stapler staples the sheet bundle, and wherein the sheet bundle is discharged by a discharging unit after the aligning portion is retracted from the sheet bundle.

11. A sheet processing apparatus comprising:

a conveying unit which conveys sheets in order from a first sheet, a second sheet, and a third sheet;

a pair of first conveying rollers which is provided downstream of the conveying unit in a sheet conveying direction and conveys the sheets while nipping the sheets at a first nip portion;

a superimposing unit which is provided between the conveying unit and the pair of first conveying rollers and superimposes a subsequent sheet on a preceding sheet in the sheet conveying direction, the superimposing unit being configured to superimpose the second sheet on the first sheet and superimpose the third sheet on the second sheet;

a pair of second conveying rollers which is provided downstream of the pair of first conveying rollers and conveys the sheets while nipping the sheets at a second nip portion;

a control unit which controls a rotation of the pair of first conveying rollers and a rotation of the pair of second conveying rollers; and an aligning portion provided downstream of the pair of first conveying rollers in the sheet conveying direction and against which a leading end in the sheet conveying direction of a conveyed sheet abuts, wherein the control unit controls the rotation of the pair of first conveying rollers and the pair of second conveying rollers so that a leading end of the second sheet reaches the second nip portion between the pair of second conveying rollers nipping the first sheet by conveying the second sheet to a downstream side before a leading end of the third sheet superimposed on the second sheet reaches the first nip portion between the pair of first conveying rollers nipping the first sheet and the second sheet superimposed on the first sheet, and wherein a sheet bundle having an aligned leading end is formed by abutting a leading end of each one of a plurality of sheets against the aligning portion.

12. The sheet processing apparatus according to claim 11, wherein the rotation of the pair of first conveying rollers and the pair of second conveying rollers is controlled so that the tail end of the first sheet passes the first nip portion between the pair of first conveying rollers by conveying the first sheet to the downstream side before the leading end of the third sheet superimposed on the second sheet reaches the second nip portion between the pair of second conveying rollers.

13. The sheet processing apparatus according to claim 11, wherein the superimposing unit includes a step which is installed in a conveying path between the conveying unit and the pair of first conveying rollers, and wherein the subsequent sheet conveyed by the conveying unit is superimposed on the preceding sheet on the step.

14. The sheet processing apparatus according to claim 11, wherein the pair of first conveying rollers includes an upper roller and a lower roller, and wherein when the pair of first conveying rollers nips two sheets, the control unit controls a driving of a driving unit so that either an upper sheet or a lower sheet nipped between the pair of first conveying rollers is conveyed by rotating either the upper roller or the lower roller.

15. The sheet processing apparatus according to claim 14, further comprising:

a brake unit which decelerates or stops the rotation of the upper roller or the lower roller when either the upper roller or the lower roller rotates.

16. The sheet processing apparatus according to claim 11, further comprising:

an aligning roller which is provided between the pair of first conveying rollers and the aligning portion and conveys the sheets so that the sheets abut against the aligning portion.

17. The sheet processing apparatus according to claim 16, wherein when a distance in a sheet conveying direction between a contact surface of the aligning wall and a nip of the aligning roller is denoted by D and a shift amount in the sheet conveying direction between a downstream end of the preceding sheet in the sheet conveying direction and a downstream end of the subsequent sheet in the sheet conveying direction is denoted by L, D and L have a relation of $D \leq L$.

18. The sheet processing apparatus according to claim 11, further comprising:

a processing unit configured to process the sheet bundle.

19. The sheet processing apparatus according to claim 18, wherein the processing unit is a stapler which staples the sheet bundle whose leading end is aligned.

20. The sheet processing apparatus according to claim 19, wherein the aligning portion retracts from the sheet bundle after the stapler staples the sheet bundle, and wherein the sheet bundle is discharged by a discharging unit after the aligning portion is retracted from the sheet bundle.

* * * * *